US011577301B2

(12) United States Patent
Chen

(10) Patent No.: US 11,577,301 B2
(45) Date of Patent: Feb. 14, 2023

(54) METHOD FOR MANUFACTURING A MULTI-FUNCTIONAL FASTENER

(71) Applicant: ESSENCE METHOD REFINE CO., LTD., Tainan (TW)

(72) Inventor: Ling-Fang Chen, Tainan (TW)

(73) Assignee: Essence Method Refine Co., Ltd., Tainan (TW)

( * ) Notice: Subject to any disclaimer, the term of this patent is extended or adjusted under 35 U.S.C. 154(b) by 363 days.

(21) Appl. No.: 17/078,252

(22) Filed: Oct. 23, 2020

(65) Prior Publication Data

US 2022/0126356 A1 Apr. 28, 2022

(51) Int. Cl.
*B21H 3/04* (2006.01)

(52) U.S. Cl.
CPC ..... *B21H 3/042* (2013.01)

(58) Field of Classification Search
CPC . B21H 3/02; B21H 3/042; B21H 3/04; B21H 3/044
USPC ..... 72/469
See application file for complete search history.

(56) References Cited

U.S. PATENT DOCUMENTS 2,336,190 A * 12/1943 Richards ..... B21H 3/027 72/469
3,831,415 A * 8/1974 Skierski ..... B21H 3/027 72/469
2004/0079133 A1* 4/2004 LeVey ..... B21H 3/02 72/469

* cited by examiner

*Primary Examiner* — Teresa M Ekiert
(74) *Attorney, Agent, or Firm* — Rosenberg, Klein & Lee

(57) ABSTRACT

A method for manufacturing a multi-functional fastener includes a preparing operation, a forming operation and a threading operation. The preparing operation prepares a metal blank cut from a length of a metal material. The forming operation is executed so that the metal blank forms a shank, a head, and a drilling portion connected to the shank. The threading operation is executed to roll the metal blank with a thread rolling set having two opposite rolling plates. Each rolling plate has slit grooves and convex units arranged in alternation. Each of the convex units has protrusions each situated between two adjacent slit grooves, which allows the threading operation to equip the shank of the metal blank with thread convolutions, slots formed between the thread convolutions for helping quick removal of chips, and main ribs formed between any two adjacent slots for increasing cutting efficiency.

20 Claims, 17 Drawing Sheets

METHOD FOR MANUFACTURING A MULTI-FUNCTIONAL FASTENER

BACKGROUND OF THIS INVENTION

1. Field of this Invention

This invention relates to a method and relates particularly to a method for manufacturing a multi-functional fastener.

2. Description of the Related Art

A general process for manufacturing a fastener is usually executed to cold forging a plurality of metal blanks to shape each metal blank with a head and a shank extending outwards from the head, then introduce each metal blank formed with the head and the shank into a thread rolling set to further form a plurality of thread convolutions on the shank of the metal blank. The conventional thread rolling set includes two rolling plates opposite each other. Each rolling plate has a rolling surface and a plurality of slit grooves recessedly formed on the rolling surface. After situating the metal blank between the rolling plates, the rolling plates presses the metal blank to move the metal blank, and the rolling of the metal blank forms a plurality of thread convolutions on the shank by the slit grooves to thereby complete the manufacturing operation of the fastener.

However, the slit grooves on the rolling surface of the thread rolling set can only shape the shank with one kind of thread convolutions, and that limits the servable range of the completed fastener. Meanwhile, the shank is formed to be cylindrical, and that increases a contact area of the shank and an object to be screwed during the screwing operation and results in increased screwing resistance. Moreover, the fastener cannot provide enough space for accommodating chips, and that causes the chips cannot be excluded duly during the screwing operation and the chips will hinder the fastener from screwing downwards smoothly to further increase the screwing difficulty and reduce the screwing speed. Further, the object may crack if the fastener keeps screwing downwards and pressing the accumulated chips. Furthermore, the fastener cannot engage with the object tightly. The fastener may loosen, sway, or fall off when the fastener is pulled or shaken by external force caused by the loosen engagement, and the screwing effect is reduced. Additional processing operations such as milling or grinding are required to shape a plurality of slots on the thread convolutions for excluding the chips after the fastener is processed by the thread rolling set. However, it costs lots of time and labor force and increases the processing costs. Furthermore, the additional processing operations weaken the strength of the processing area of the fastener, and that will result in fatigue of metals. Thus, the fastener may be snapped easily, and that requires to be improved.

SUMMARY OF THIS INVENTION

The object of this invention is to provide a method for manufacturing a multi-functional fastener capable of attaining chips accommodation and quick removal of chips, reducing screwing resistance, preventing an object to be screwed from being cracked, and achieving preferable screwing effect.

The method of this invention includes a preparing operation, a forming operation and a threading operation. The preparing operation prepares a metal blank being a portion cut from a length of a metal material. The forming operation is executed to shape the metal blank so that the metal blank is provided with a shank, a head and a drilling portion connected to two ends of the shank respectively. The threading operation is executed to prepare a thread rolling set including two opposite rolling plates and roll the metal blank with the rolling plates. Each rolling plate has a rolling surface, an entrance end and an exit end formed at two ends of the rolling plate respectively, a top end defined between the entrance end and the exit end, and a bottom end defined in opposing relationship to the top end. The rolling surface has a plurality of slit grooves recessedly formed thereon and spaced from each other. A plurality of convex units is formed on the rolling surface and alternates with the slit grooves. Each convex unit is arranged in a line and has a plurality of protrusions. Each protrusion is situated between two adjacent slit grooves. The rolling of the metal blank between the two rolling plates moves the metal blank from the entrance end to the exit end to thereby form a plurality of thread convolutions, a plurality of slots, and a plurality of main ribs on the shank of the metal blank, with each slot situated between two adjacent thread convolutions, and each main rib situated between two adjacent slots. Thus, a contact area of the shank and an object to be screwed is reduced effectively. The main ribs can help increase cutting efficiency and the slots allow chips to be excluded speedily to thereby accelerate the screwing operation and save labor force. Meanwhile, the screwing resistance is reduced to prevent the object to be screwed from being cracked and achieve the preferable screwing effect.

Preferably, the drilling portion can have a pointed tail, a self-tapping tail, or a flat tail.

Preferably, an imaginary reference line is defined by passing through a central point of the top end and a central point of the bottom end. Each protrusion is inclined to the imaginary reference line.

Preferably, an imaginary reference line is defined by passing through a central point of the top end and a central point of the bottom end. Each protrusion is parallel to the imaginary reference line.

Preferably, a hole is formed at one end of each protrusion of the rolling surface and is configured to form an auxiliary rib on each main rib of the metal blank in the threading operation.

Preferably, each protrusion includes a straight surface and a curved surface connected to the straight surface.

Preferably, each protrusion is formed into either a curved shape or a conical shape.

Preferably, an imaginary reference line is defined by passing through a central point of the top end and a central point of the bottom end. Each line formed by arranging each convex unit is inclined to the imaginary reference line.

Preferably, an imaginary reference line is defined by passing through a central point of the top end and a central point of the bottom end. Each line formed by arranging each convex unit is parallel to the imaginary reference line.

Preferably, the rolling surface includes at least one protuberance configured to form a plurality of notches on the thread convolutions of the metal blank in the threading operation.

Preferably, the auxiliary rib protrudes from a surface of each main rib at a rib protruding height. The rib protruding height is at least 0.05 mm.

Preferably, two slot reference lines passing through two ends of each slot extend and converge at a center of the shank of the metal blank to define a slot included angle. The slots define a plurality of slot included angles. The sum of the slot included angles is defined as a first angle. A second angle is defined by subtracting the first angle from 360 degrees. A ratio of the first angle to the second angle is between 1:7 and 3:5.

Preferably, an outer periphery of the shank of the metal blank defines a peripheral envelope length. The auxiliary rib defines a peripheral width. A ratio of the peripheral envelope length of the shank to the peripheral width of the auxiliary rib is 1 to at least 0.020.

Preferably, the slots and the main ribs of the metal blank are formed between five and six thread convolutions.

Preferably, the protrusions of each convex unit protrude from the rolling surface at an identical protruding height sequentially arranged from the top end to the bottom end to thereby allow the threading operation to form the slots of the metal blank with an equal slot width and an equal slot depth.

Preferably, the protrusions of each convex unit protrude from the rolling surface at a main protruding height sequentially arranged from the top end to the bottom end. The main protruding height is gradually increased from the top end to the bottom end to thereby divide the shank of the metal blank into a first cutting portion connected to the head and a second cutting portion connected to the drilling portion in the threading operation and allow the slots to be respectively formed on the first cutting portion and the second cutting portion. The slots within the first cutting portion define a first slot depth smaller than a second slot depth of the slots within the second cutting portion.

Preferably, the rolling surface of each rolling plate includes a first surface section connected to the top end and a second surface section connected to the bottom end. The thread operation equips the first surface section and the second surface section with the convex units and the protrusions. The protrusions of each convex unit protrude from the first surface section and from the second surface section at a first protruding height and a second protruding height respectively. The first protruding height within the first surface section is smaller than the second protruding height within the second surface section to provide an arrangement with two-sectional heights whereby the shank of the metal blank defines a first cutting portion connected to the head and a second cutting portion connected to the drilling portion. The slots are respectively formed on the first cutting portion and the second cutting portion in the threading operation. The slots within the first cutting portion define a first slot depth smaller than a second slot depth of the slots within the second cutting portion.

Preferably, the protrusions of each convex unit define a main width sequentially arranged from the top end to the bottom end. The main width is gradually increased from the top end to the bottom end to thereby divide the shank into a first cutting portion connected to the head and a second cutting portion connected to the drilling portion and allow the slots to be respectively formed on the first cutting portion and the second cutting portion in the threading operation. The slots within the first cutting portion define a first slot width smaller than a second slot width of the slots within the second cutting portion.

Preferably, the rolling surface of each rolling plate includes a first surface section connected to the top end and a second surface section connected to the bottom end. The thread operation equips the first surface section and the second surface section with the convex units and the protrusions. The protrusions of each convex unit defines a first width and a second width for the first surface section and the second surface section respectively. The first width within the first surface section is smaller than the second width within the second surface section to provide an arrangement with two-sectional widths whereby the shank of the metal blank defines a first cutting portion connected to the head and a second cutting portion connected to the drilling portion. The slots are respectively formed on the first cutting portion and the second cutting portion in the threading operation. The slots within the first cutting portion define a first slot width smaller than a second slot width of the slots within the second cutting portion.

Preferably, each rolling plate includes a blank area and a plurality of protuberances formed on the rolling surface.

DETAILED DESCRIPTION OF THE PREFERRED EMBODIMENTS

Figure 1:
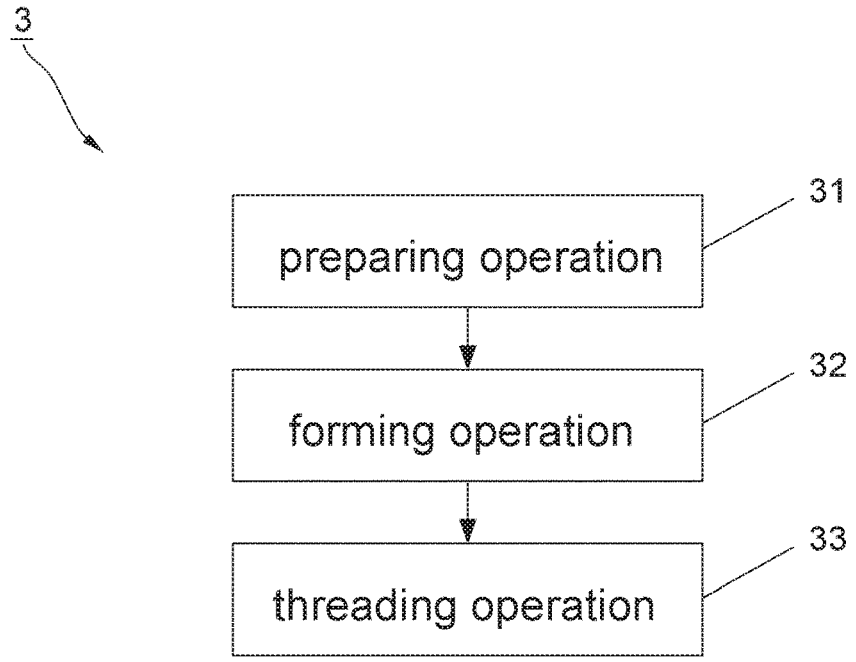
FIG. 1 is a block diagram showing the operations of a first preferred embodiment of this invention in sequential order.
Figure 2A:
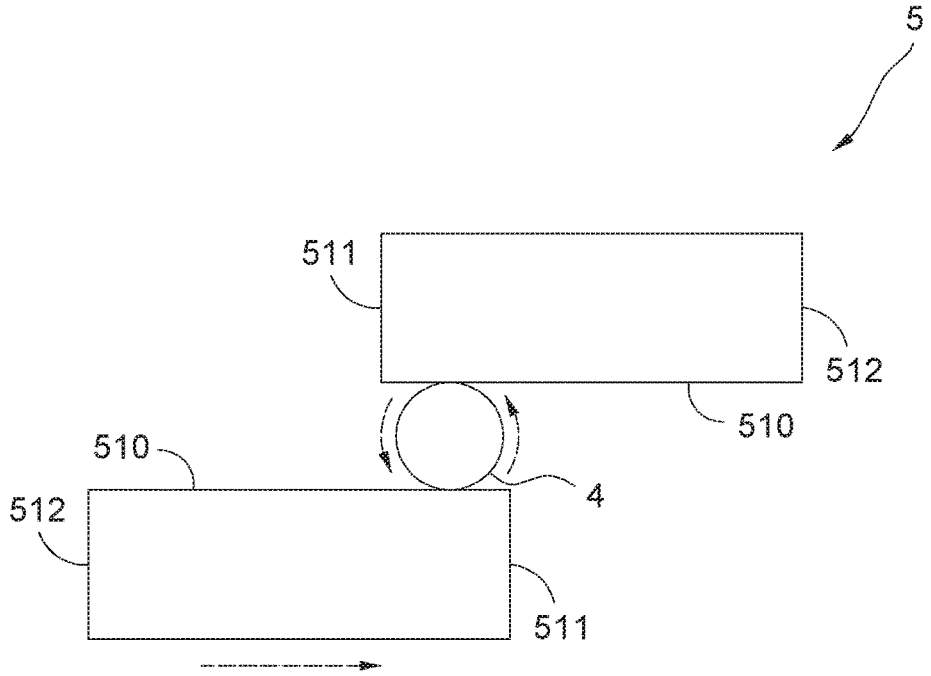
FIG. 2A is a schematic view showing the rolling of a metal blank between the rolling plates.
Figure 2B:
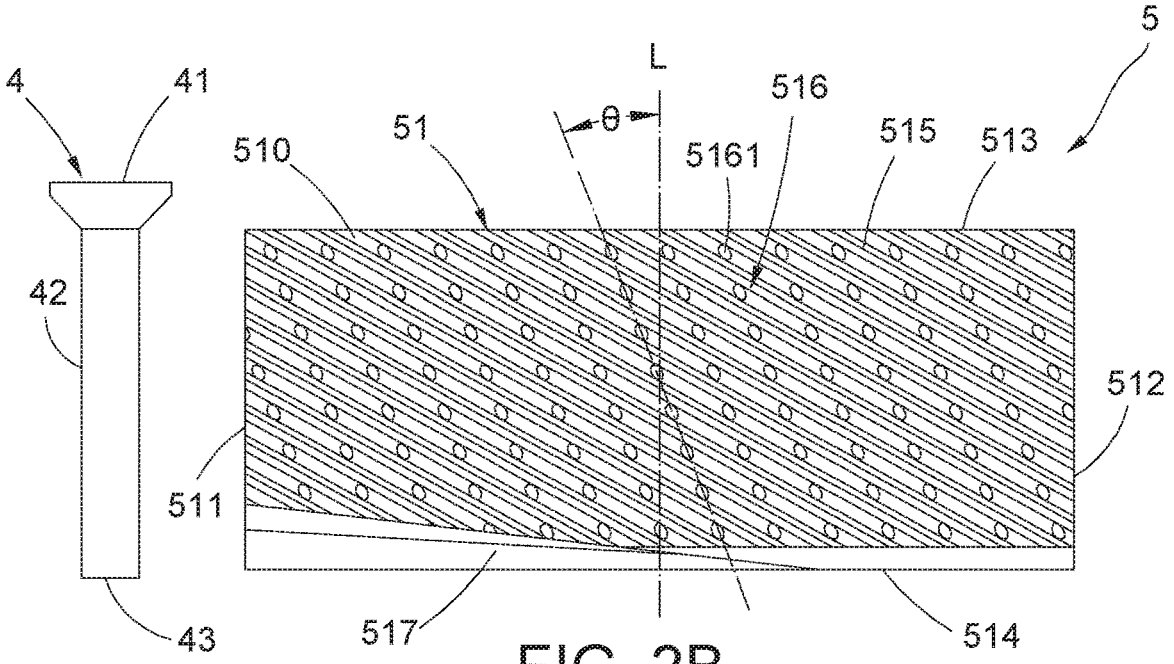
FIG. 2B is a schematic view showing the rolling plate equipped in the threading operation of the first preferred embodiment.
Figure 4A:
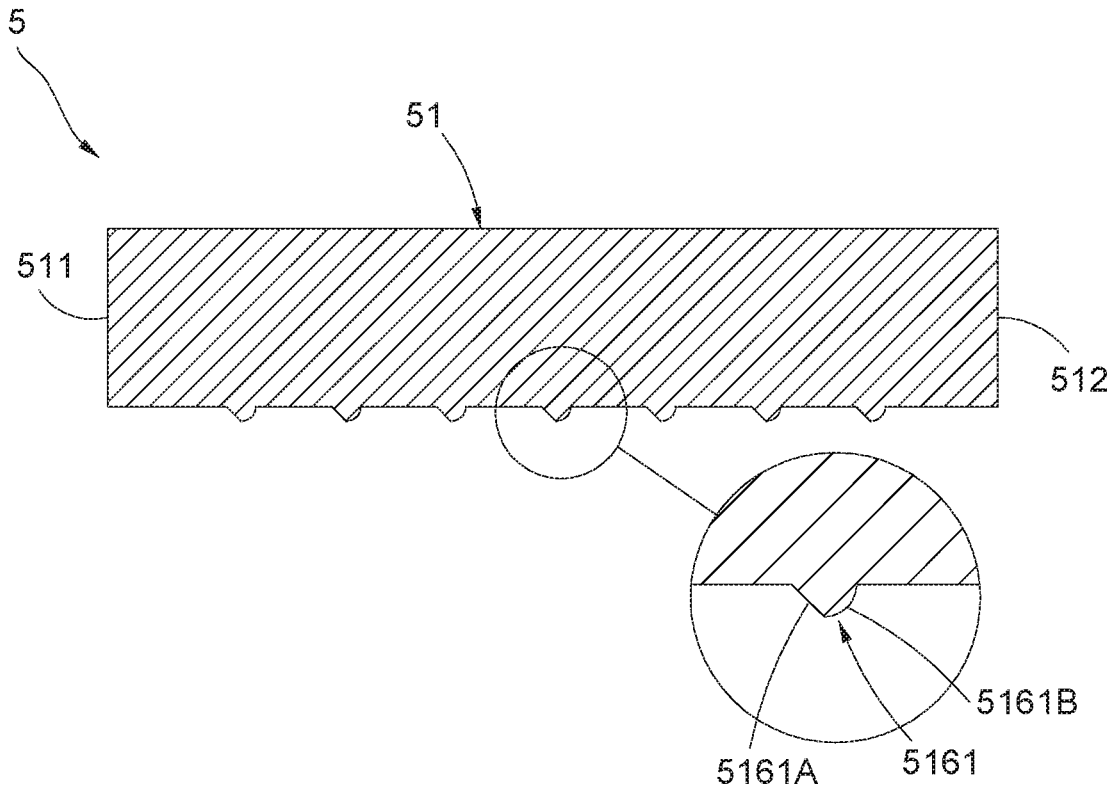
FIGS. 4A and 4B are cross-sectional views showing that the protrusions of each convex unit have a straight surface and a curved surface.
Figure 4B:
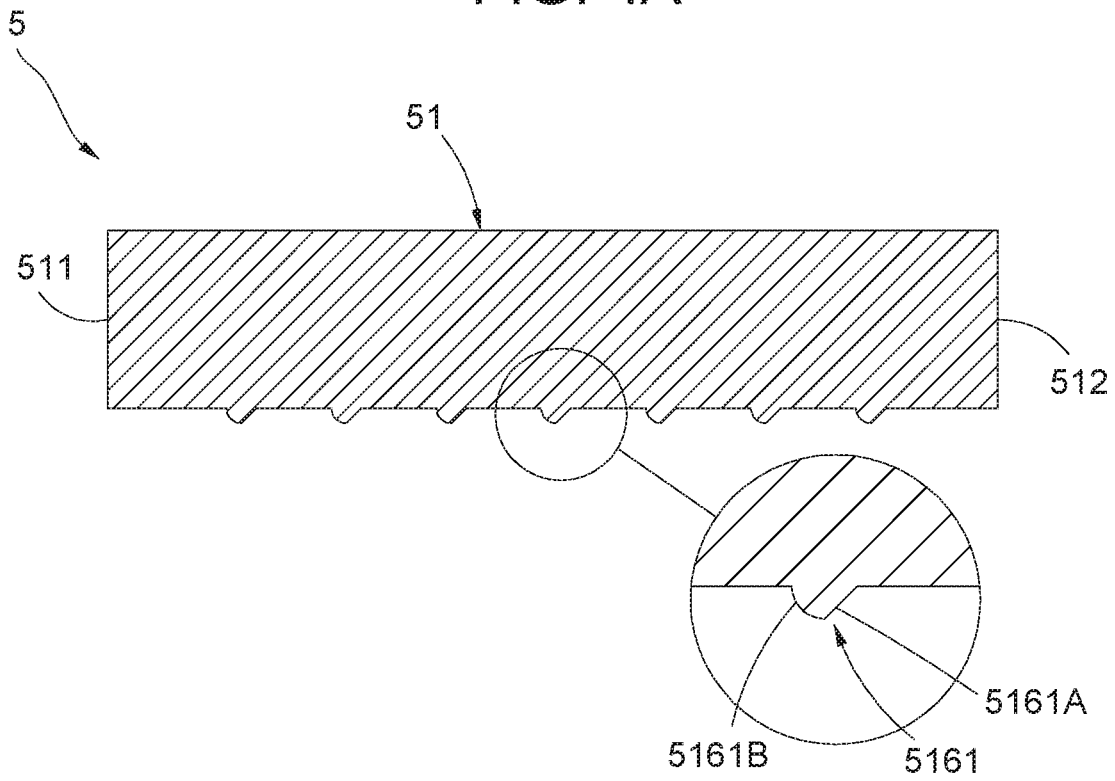
Figure 4C:
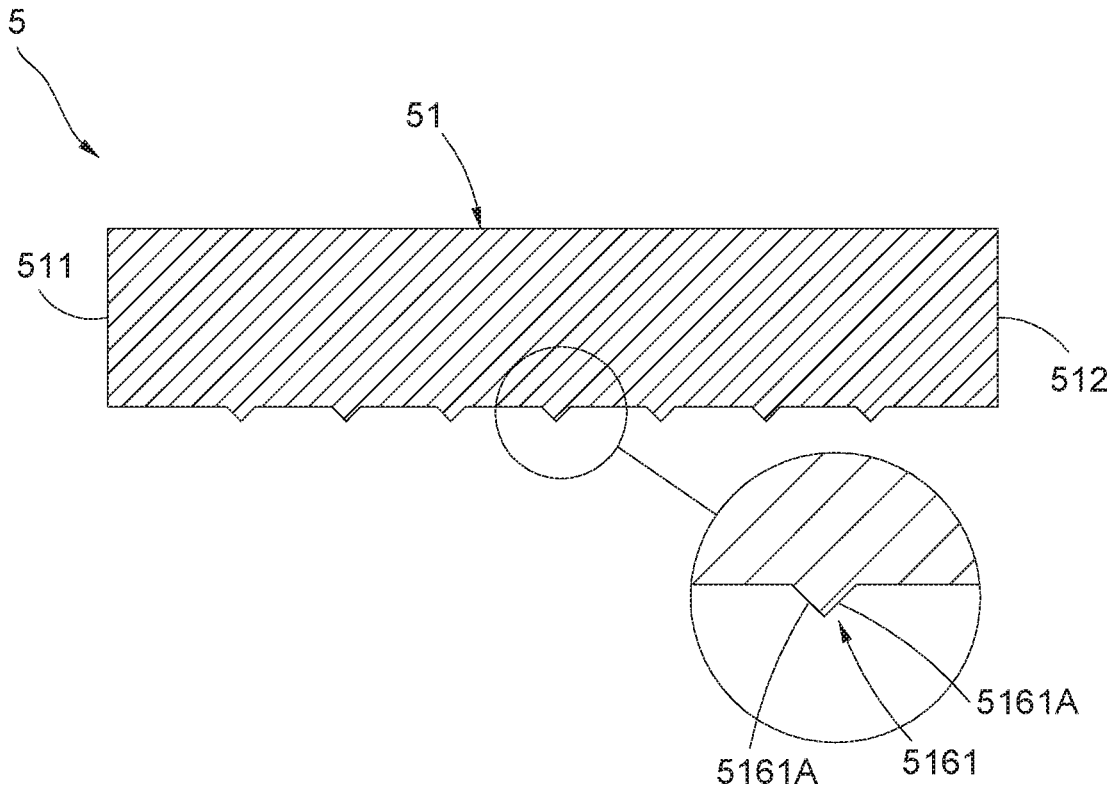
FIG. 4C is a cross-sectional view showing that the protrusions of each convex unit is formed into a conical shape.
Figure 4D:
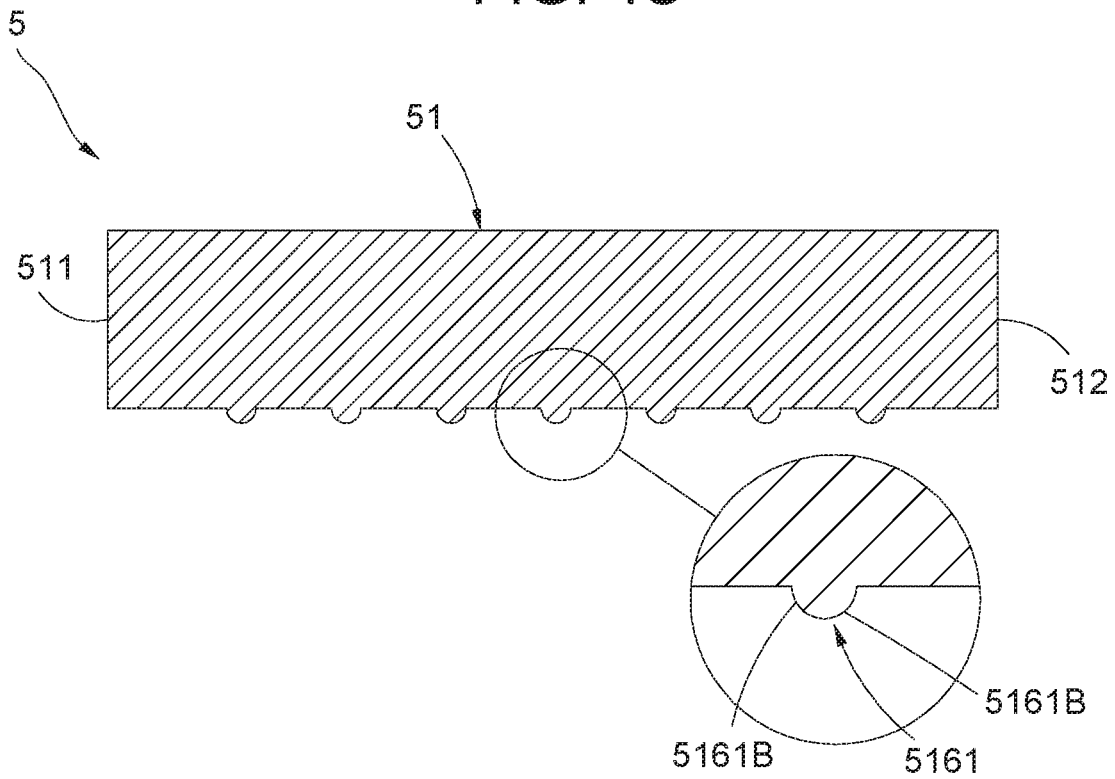
FIG. 4D is a cross-sectional view showing that the protrusions of each convex unit is formed into a curved shape.

Referring to FIGS. 1, 2A and 2B, a method 3 for manufacturing a multi-functional fastener of a first preferred embodiment of this invention includes a preparing operation 31, a forming operation 32, and a threading operation 33. The preparing operation 31 prepares a metal blank 4 made by cutting a metal material (not shown) into sections. The forming operation 32 is executed to shape the metal blank 4 so that the metal blank 4 is provided with a head 41, a shank 42 extending from the head 41, and a drilling portion 43 connected to the shank 42 and opposite to the shank 42. The threading operation 33 is executed to prepare a thread rolling set 5 including two rolling plates 51 opposite each other and situate the metal blank 4 between the two rolling plates 51 to thereby roll and thread the shank 42 of the metal blank 4. Each rolling plate 51 has a rolling surface 510, an entrance end 511 formed at one end of the rolling plate 51, an exit end 512 formed at another end of the rolling plate 51, a top end 513 defined between the entrance end 511 and the exit end 512, and a bottom end 514 defined in opposing relationship to the top end 513. The rolling surface 510 has a plurality of slit grooves 515 recessedly formed thereon and spaced from each other. A plurality of convex units 516 is formed on the rolling surface 510 and alternating with the slit grooves 515. Each convex unit 516 is arranged in a line and has a plurality of protrusions 5161. Each protrusion 5161 is situated between two adjacent slit grooves 515. In this preferred embodiment, a tail forming portion 517 is disposed on each rolling surface 510 and connected to the bottom end 514. The drilling portion 43 can be processed into a pointed tail, a self-tapping tail and a flat tail by the tail forming portion 517. An imaginary reference line L is defined by passing through a central point of the top end 513 and a central point of the bottom end 514. Each protrusion 5161 is inclined to the imaginary reference line L. Each line formed by arranging each convex unit 516 is also inclined to the imaginary reference line L at an angle θ which is preferable to range between 5° and 20°. Referring to FIGS. 4A and 4B, each protrusion 5161 includes a straight surface 5161A and a curved surface 5161B connected to the straight surface 5161A. Or, each protrusion 5161 is formed into either a curved shape namely to have two curved surfaces 5161B, or a conical shape namely to have two straight surfaces 5161A.

Figure 3:
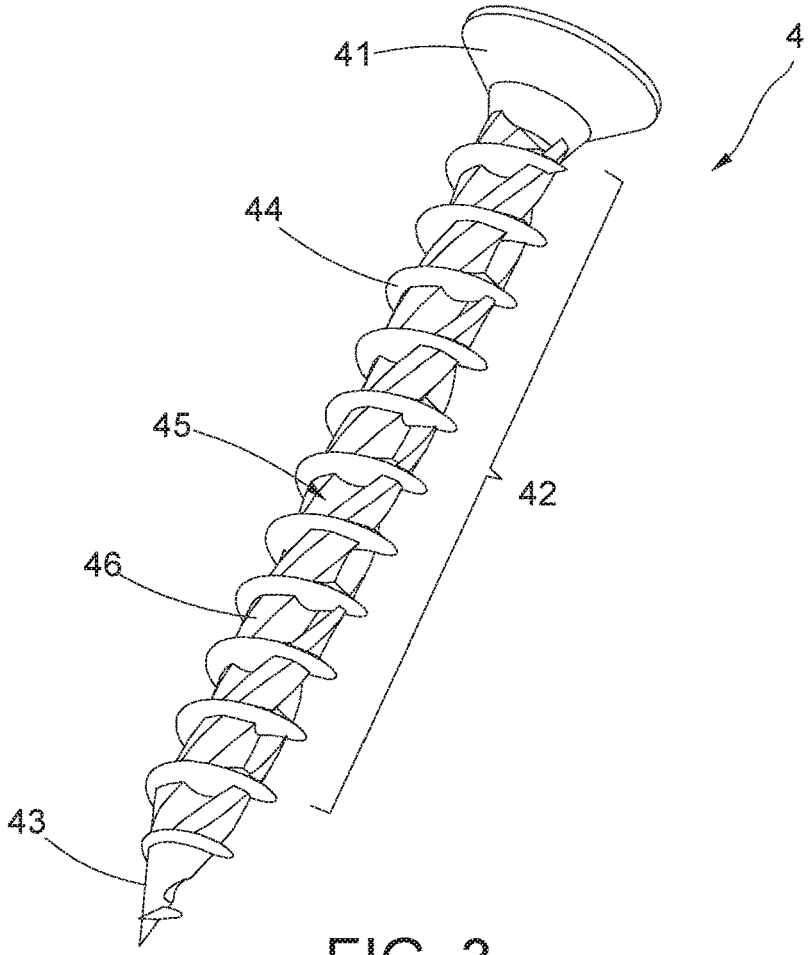
FIG. 3 is a perspective view showing the completed fastener formed in the first preferred embodiment.

Referring to FIGS. 2A, 2B and 3, in the threading operation 33, the thread rolling set 5 is preferably disposed on a thread rolling machine (not shown) when using. Each metal blank 4 is situated between the rolling plates 51 to move the metal blank 4 from the entrance ends 511 to the exit ends 512 to thereby form a plurality of thread convolutions 44, a plurality of slots 45, and a plurality of main ribs 46 on the shank 42 of the metal blank 4, with each slot 45 situated between two adjacent thread convolutions 44, and each main rib 46 situated between two adjacent slots 45 by the slit grooves 515 and the convex units 516. A number of the slots 45 and a number of the main ribs 46 disposed on the shank 42 are preferable to be between 2 and 3. The drilling portion 43 is formed to be a pointed tail by the tail forming portion 517 in this preferred embodiment. Hence, inner grains of the slots 45 can be pressed to compress the grains and allow the grains to become finer. Meanwhile, the metal strength of the slots 45 and surrounding areas is increased. And, the surface roughness of the slots 45 is reduced. Therefore, the method 3 can increase the surface strength and avoid slight cracks to thereby reduce the probability that metal fatigue happens. Simultaneously, the reduced surface roughness of the slots 45 help quick removal of the chips generated in the screwing operation. Thus, the chips can be excluded outwards through the slots 45 smoothly.

Referring to FIG. 3, during the screwing operation, a rotational force is applied on the head 41 to carry out a rotation of the drilling portion 43 to drill into an object to be screwed (not shown). And, the thread convolutions 44 then continue to cut the object and the main ribs 46 can help the cutting operation of the thread convolutions 44 to thereby increase the cutting efficiency, break fibers of the object effectively, prevent the shank 42 from being entangled in the fibers of the object, and reduce the screwing resistance. Moreover, chips generated in the screwing operation can be accommodated and excluded through the slots 45 speedily to thereby attain quick removal of the chips, prevent the screwing operation from being hindered by the accumulated chips, and prevent the object from being cracked caused when the fastener keeps pressing the accumulated chips. Further, the slots 45 help reduce a contact area of the shank 42 and the object to thereby accelerate the screwing operation, save labor force, reduce the screwing resistance, and achieve the preferable screwing effect.

Figure 5:
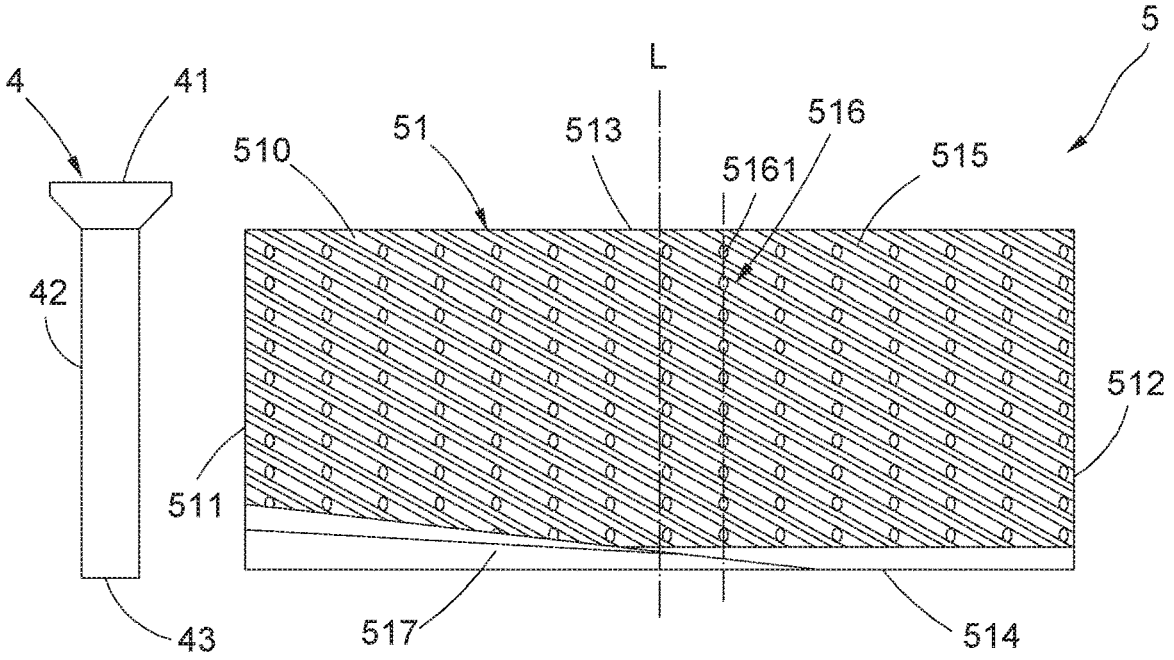
FIG. 5 is a schematic view showing the rolling plate equipped in the threading operation of a second preferred embodiment.
Figure 6:
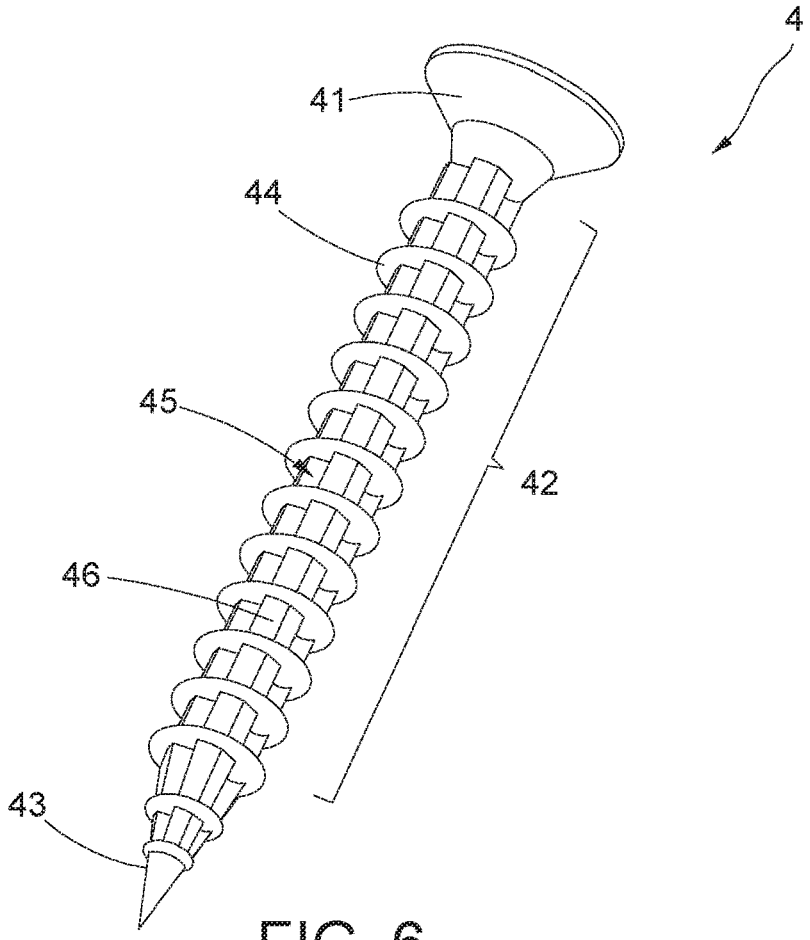
FIG. 6 is a perspective view showing the completed fastener formed in the second preferred embodiment.

Referring to FIGS. 5 and 6 show a second preferred embodiment of this invention. This embodiment is characterized in that each protrusion 5161 of the rolling surface 510 of the rolling plate 51 equipped in the threading operation 33 is parallel to the imaginary reference line L. Each line formed by arranging each convex unit 516 is also parallel to the imaginary reference line L, namely each line of the convex units 516 does not converge with the imaginary reference line L (0°). Thus, after preparing the metal blank 4 which is a portion cut from a length of a metal material (not shown) in the preparing operation 31 and shaping the metal blank 4 with the shank 42, the head 41 and the drilling portion 43 connected to the shank 42 respectively in the forming operation 32, the metal blank 4 is placed between the rolling plates 51 to equip the metal blank 4 with the thread convolutions 44, the slots 45 and the main ribs 46 on the shank 42 in the threading operation 33. The slots 45 and the main ribs 46 are formed to be parallel to the central axis of the shank 42 of the metal blank 4. Hence, the thread convolutions 44 and the main ribs 46 can cut an object to be screwed (not shown) and break the fibers of the object effectively to thereby reduce the screwing resistance generated during the screwing operation and avoid the entanglement of the fibers on the shank 42. Meanwhile, the slots 45 can accommodate the chips properly and remove the chips outwards smoothly. Further, a contact area of the shank 42 and the object is reduced through the slots 45 to thereby speed the screwing operation up, save labor force, reduce the screwing resistance, and obtain the preferable screwing effect.

Figure 7:
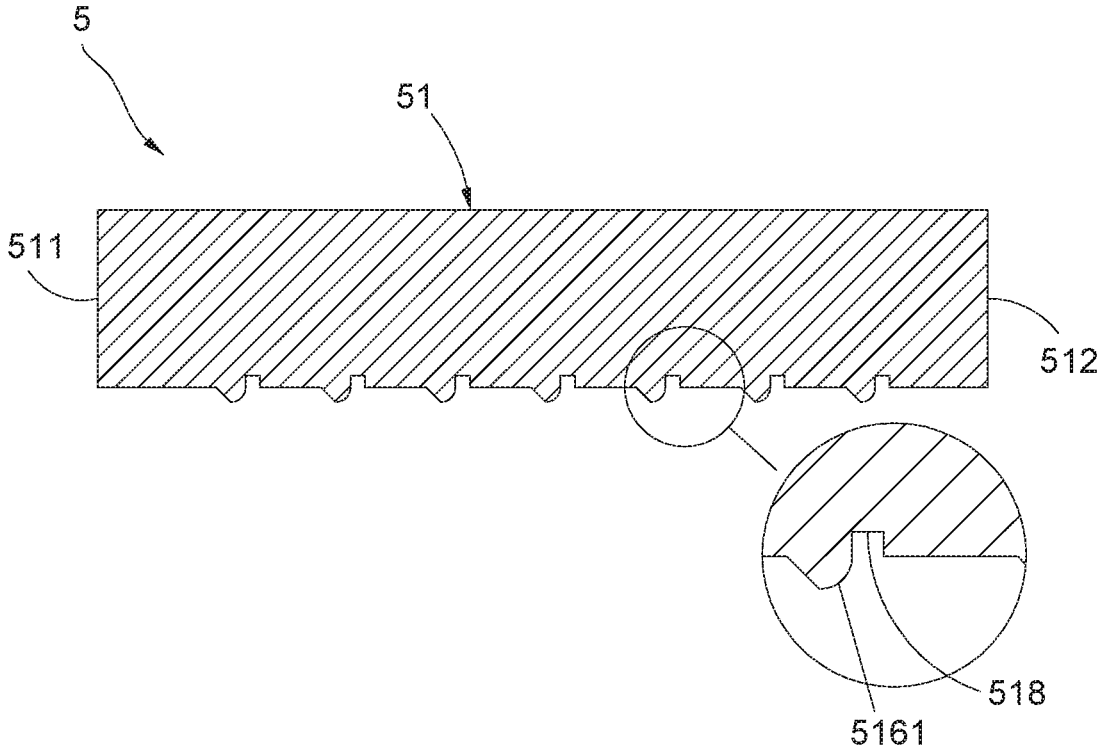
FIG. 7 is a cross-sectional view showing the rolling plate equipped in the threading operation of a third preferred embodiment.
Figure 8:
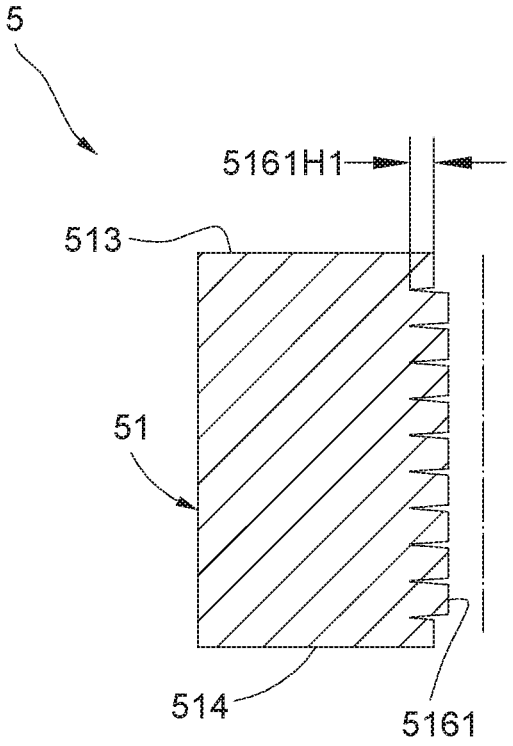
FIG. 8 is a cross-sectional view showing an identical protruding height of the protrusions of each convex units.
Figure 9:
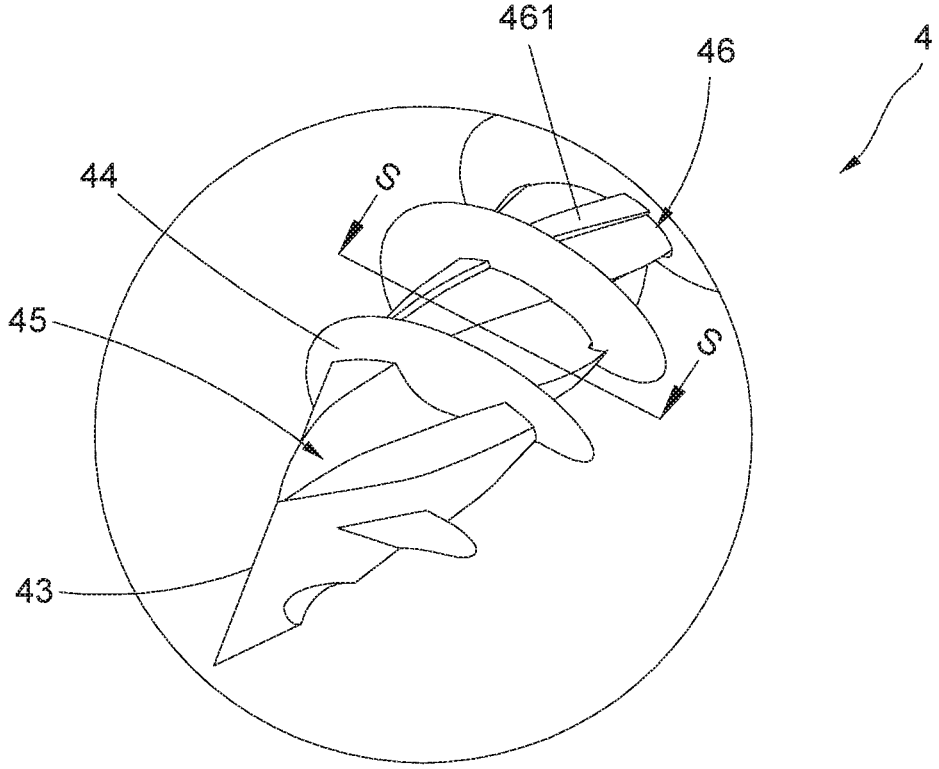
FIG. 9 is an enlarged view showing the completed fastener formed in the third preferred embodiment.
Figure 10:
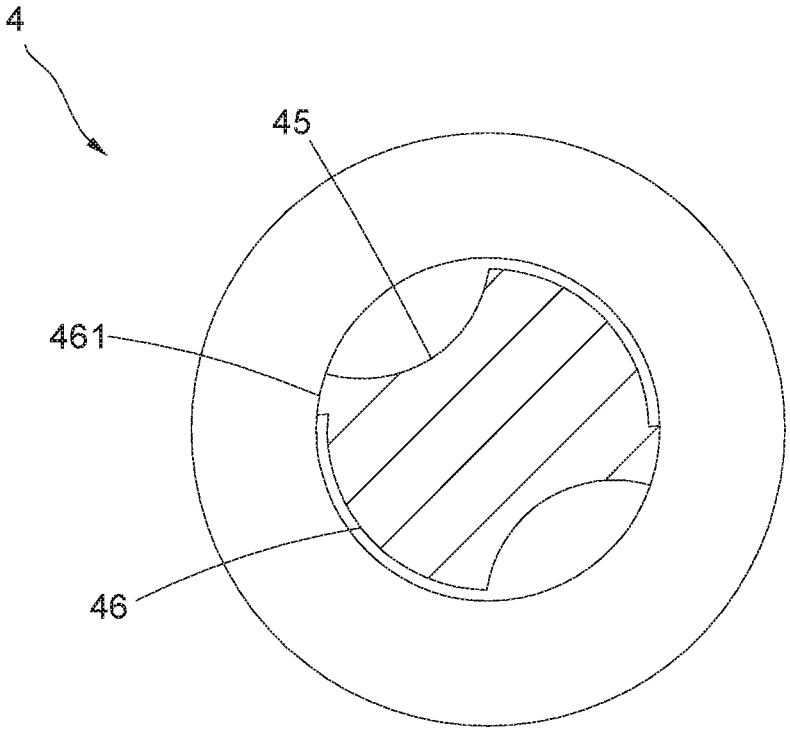
FIG. 10 is a cross-sectional view showing the completed fastener as seen along the line S-S of FIG. 9.

Referring to FIGS. 7, 8 and 9 show a third preferred embodiment of this invention. This embodiment is characterized in that the rolling surface 510 of each rolling plate 51 equipped in the threading operation 33 has a hole 518 formed at one end of each protrusion 5161. The protrusions 5161 of each convex unit 516 protrude from the rolling surface 510 at an identical protruding height 5161H1 sequentially arranged from the top end 513 to the bottom end 514. After preparing the metal blank 4 in the preparing operation 31 and providing the metal blank 4 with the head 41, the shank 42 and the drilling portion 43 in the forming operation 32, the metal blank 4 is then placed between the rolling plates 51 in the threading operation 33 to roll the shank 42 of the mental blank 4 to thereby form the thread convolutions 44, the slots 45, and the main ribs 46 on the shank 42 of the metal blank 4. Further, An auxiliary rib 461 is formed on each main rib 46 of the metal blank 4 by the holes 518. The slots 45 of the metal blank 4 are formed to have an equal slot width and an equal slot depth because of the identical protruding height 5161H1 of the protrusions 5161 as shown in FIG. 10. Thus, the auxiliary ribs 461 can help enlarge the slots 45 to thereby allow the chips to enter into the slots 45 quickly. Meanwhile, a contact area of the main ribs 46 and an object to be screwed (not shown) is reduced by the auxiliary ribs 461 to thereby accelerate the screwing operation, save labor force, reduce the screwing resistance greatly, and attain the preferable screwing effect.

Figure 11A:
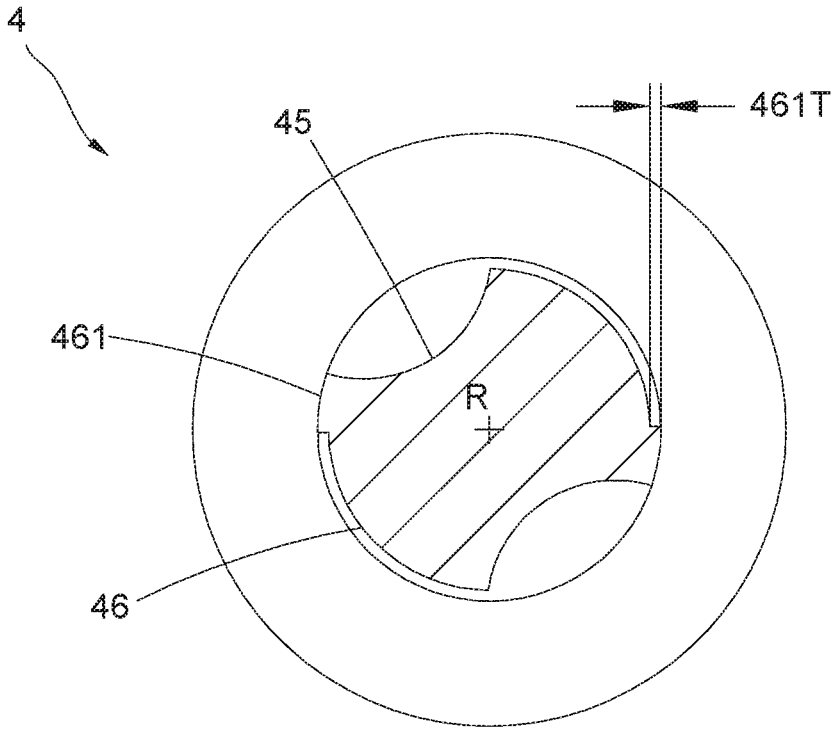
FIG. 11A is a cross-sectional view showing a rib protruding height of each auxiliary rib.
Figure 11B:
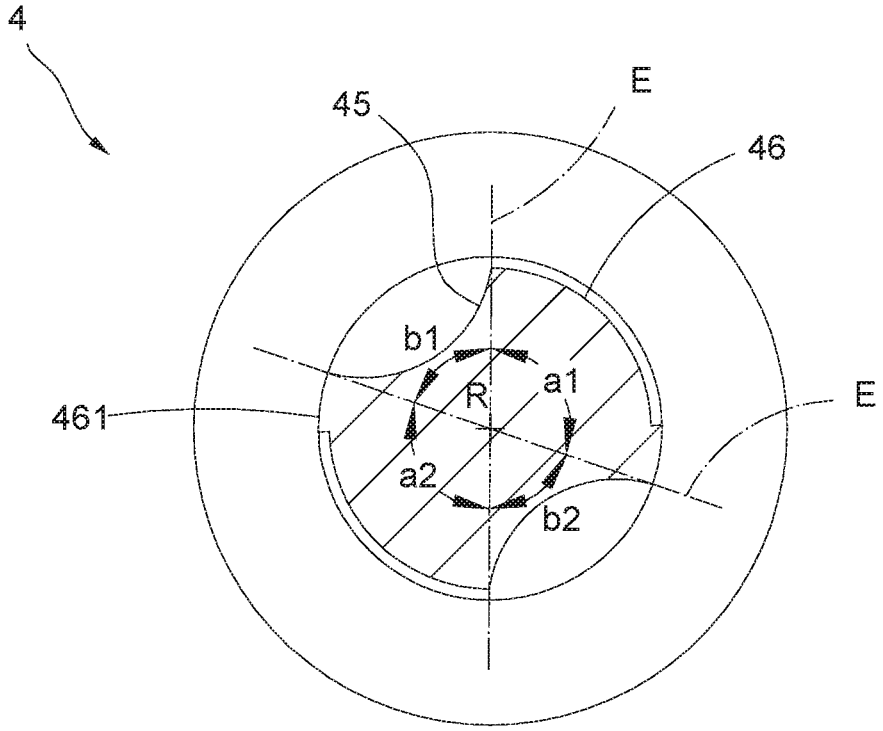
FIG. 11B is a cross-sectional view showing a first angle and a second angle.
Figure 11C:
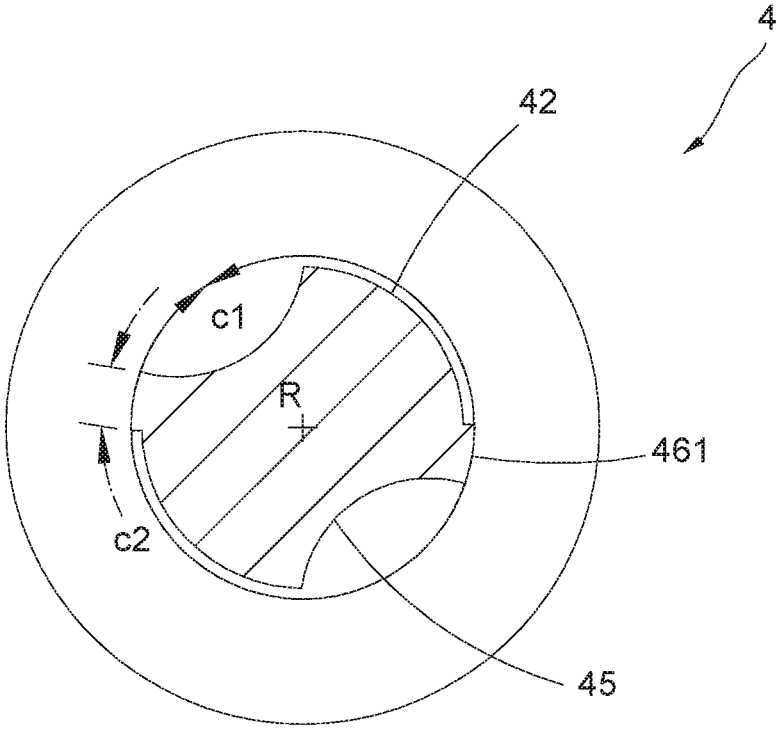
FIG. 11C is a cross-sectional view showing a peripheral envelope length of the shank and a peripheral width of each auxiliary rib.
Figure 11D:
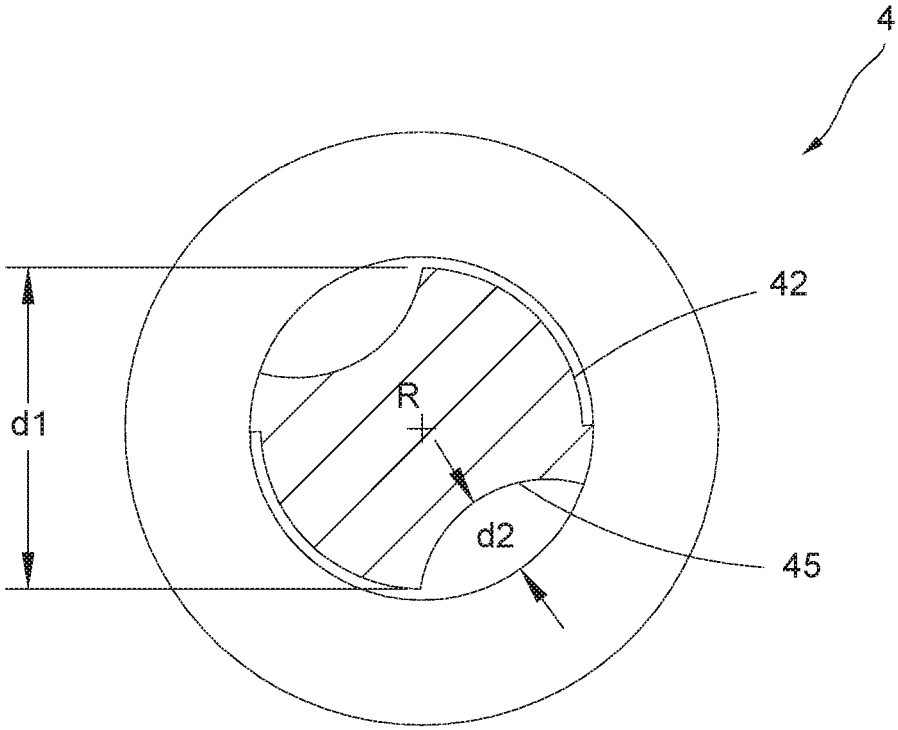
FIG. 11D is a cross-sectional view showing a diameter of the shank and a slot depth of each slot.

Referring to FIGS. 11A and 11B, the auxiliary rib 461 protrudes from a surface of each main rib 46 at a rib protruding height 461T. The rib protruding height 461T can be increased or reduced based on the property of the metal blank 4. The rib protruding height 461T is preferable to range between 0.05 mm and 0.35 mm. Two slot reference lines E passing through two ends of each slot 45 extend and converge at a center R of the shank 42 of the metal blank 4 to define a slot included angle (b1, b2). The slots 45 define a plurality of slot included angles (b1, b2). The sum of the slot included angles (b1, b2) is defined as a first angle. A second angle is defined by subtracting the first angle from 360 degrees. Referring to FIG. 11B, the second angle refers to the sum of the angles (a1, a2). A ratio of the first angle to the second angle is between 1:7 and 3:5. Referring to FIG. 11C, an outer periphery of the shank 42 of the metal blank 4 defines a peripheral envelope length c1. The auxiliary rib 461 defines a peripheral width c2. A ratio of the peripheral envelope length c1 of the shank 42 to the peripheral width c2 of the auxiliary rib 461 is 1:0.020~0.10 to thereby prevent the auxiliary ribs 461 from being damaged. Referring to FIG. 11D, a ratio of a diameter d1 of the shank 42 to a slot depth d2 of each slot 45 is 1:0.06~0.25.

Figure 12A:
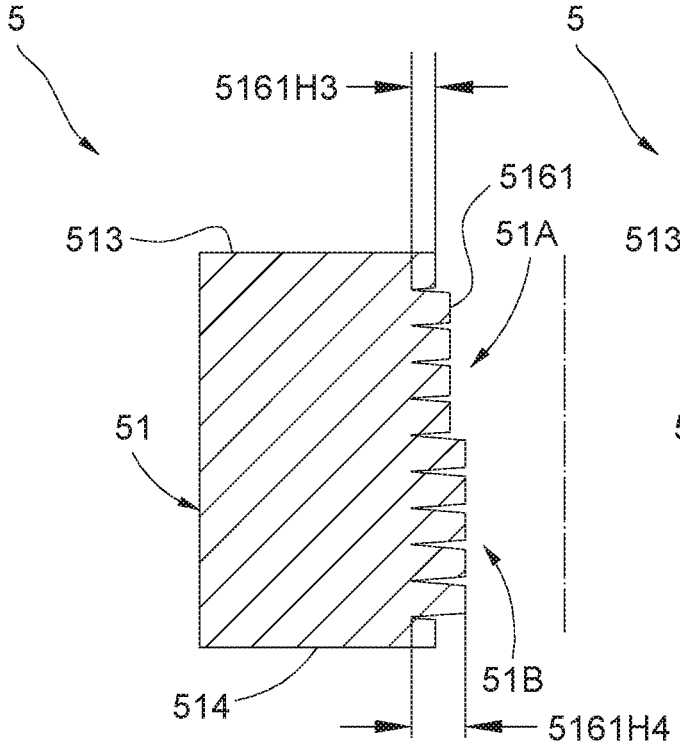
FIG. 12A-12B is a cross-sectional view showing the rolling plate equipped in the threading operation of a fourth preferred embodiment.
Figure 12B:
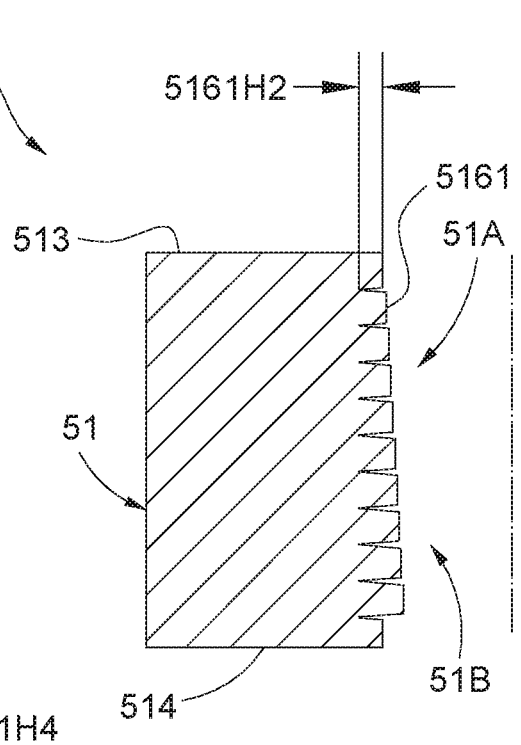
Figure 13:
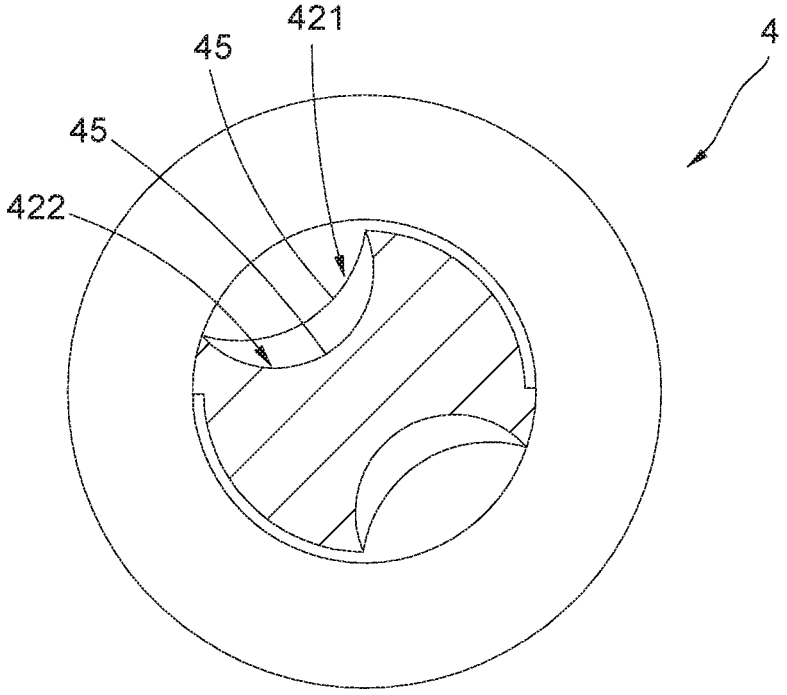
FIG. 13 is a cross-sectional view showing a first slot depth of the slots within the first cutting portion and a second slot depth of the slots within the second cutting portion as seen along the line S-S of FIG. 14.
Figure 14:
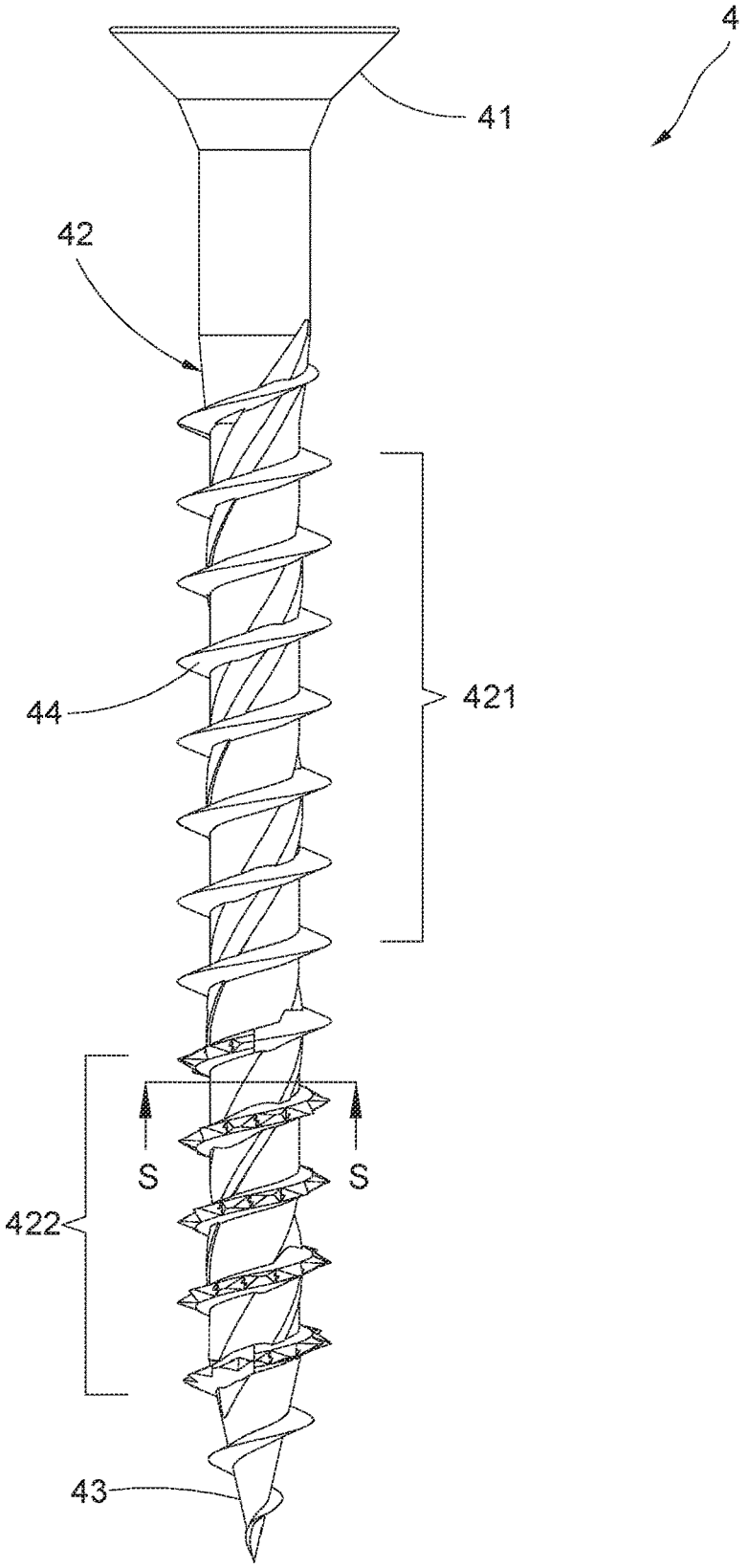
FIG. 14 is a schematic view showing the completed fastener formed in the fourth preferred embodiment.

Referring to FIGS. 12A and 12B show a fourth preferred embodiment of this invention. This embodiment is characterized in that the protrusions 5161 of each convex unit 516 protrude from the rolling surface 510 at a main protruding height 5161H2 sequentially arranged from the top end 513 to the bottom end 514. The main protruding height 5161H2 is gradually increased from the top end 513 to the bottom end 514 as shown in FIG. 12B. Thus, in the threading operation 33, the shank 42 of the metal blank 4 is rolled by the rolling plates 51 to thereby divide the shank 42 into a first cutting portion 421 connected to the head 41 and a second cutting portion 422 connected to the drilling portion 43 and allow the slots 45 to be respectively formed on the first cutting portion 421 and the second cutting portion 422. The slots 45 within the first cutting portion 421 define a first slot depth smaller than a second slot depth of the slots 45 within the second cutting portion 422. Alternatively, as shown in FIG. 12A, the rolling surface 510 of each rolling plate 51 includes a first surface section 51A connected to the top end 513 and a second surface section 51B connected to the bottom end 514. The thread operation 33 equips the first surface section 51A and the second surface section 51B with the convex units 516 and the protrusions 5161. The protrusions 5161 of each convex unit 516 protrude from the first surface section 51A and from the second surface section 51B at a first protruding height 5161H3 and a second protruding height 5161H4 respectively. The first protruding height 5161H3 within the first surface section 51A is smaller than the second protruding height 5161H4 within the second surface section 51B to provide an arrangement with two-sectional heights whereby the shank 42 of the metal blank 4 defines a first cutting portion 421 connected to the head 41 and a second cutting portion 422 connected to the drilling portion 43. The slots 45 within the first cutting portion 421 define a first slot depth smaller than a second slot depth of the slots 45 within the second cutting portion 422 as shown in FIGS. 13 and 14. Thus, the slots 45 within the second cutting portion 422 can accommodate more chips and increase the cutting efficiency to thereby facilitate the exclusion of the chips in the beginning of the screwing operation. Meanwhile, the slots 45 within the first cutting portion 421 can also be adapted to help exclude the chips and increase the whole strength of the fastener. The smaller second slot depth of each slot 45 within the first cutting portion 421 allows the chips to accumulate duly. Thus, the chips can press a drilling hole (not shown) outwards during the screwing operation to thereby attain the tight engagement of the fastener and an object to be screwed (not shown) and prevent the drilling portion 43 of the fastener from being swayed.

Figure 15A:
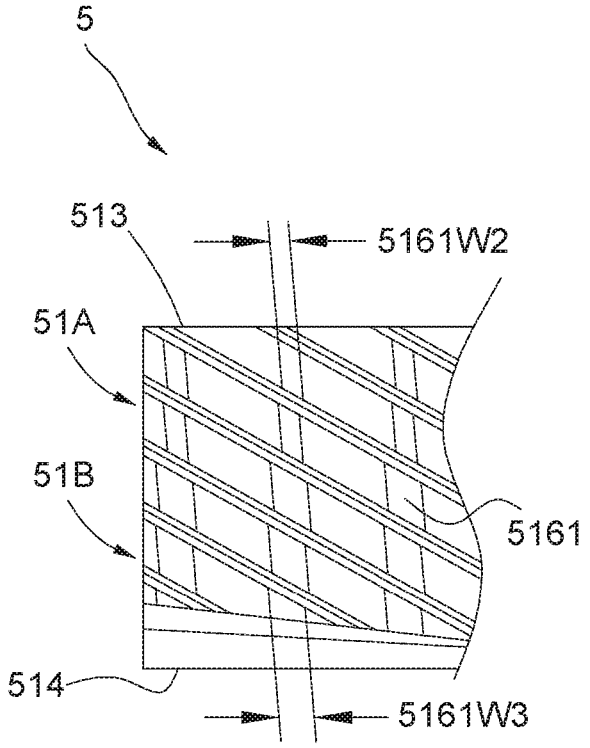
FIG. 15A-15B is a schematic view showing the rolling plate equipped in the threading operation of a fifth preferred embodiment.
Figure 15B:
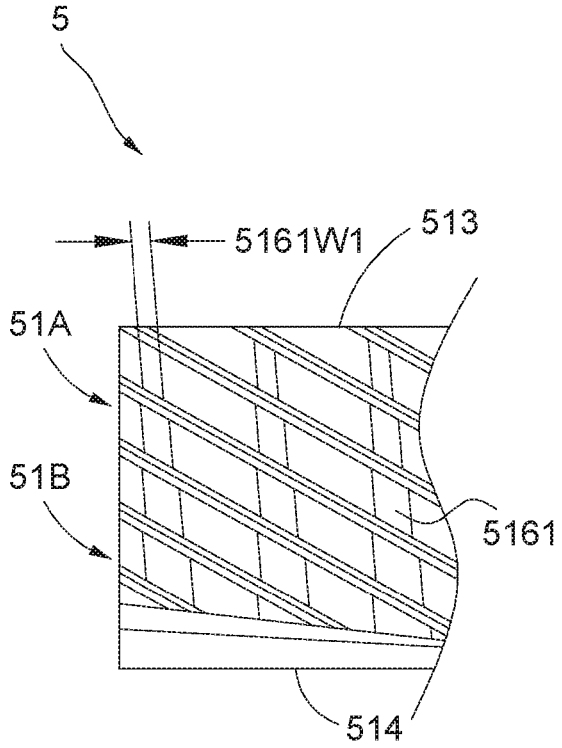
Figure 16:
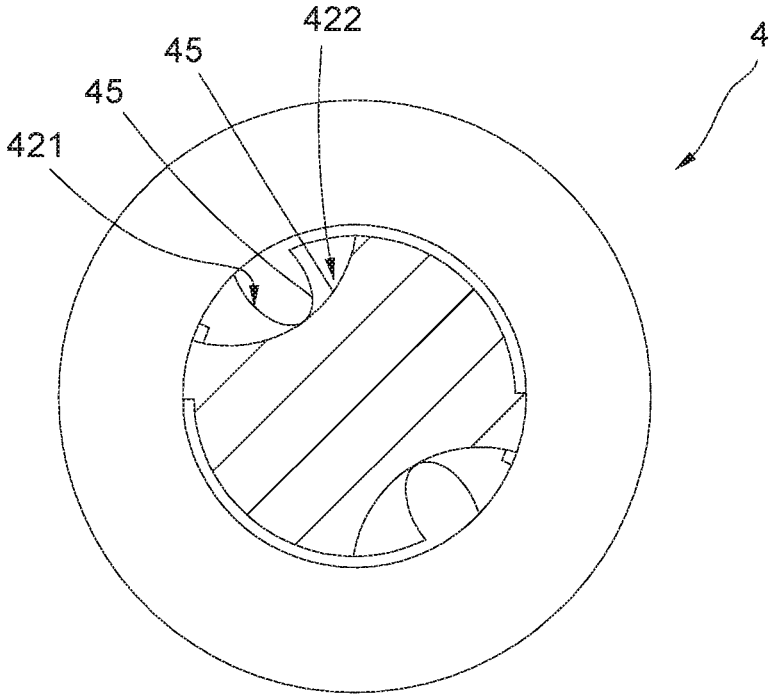
FIG. 16 is a cross-sectional view showing a first slot width of the slots within the first cutting portion and a second slot width of the slots within the second cutting portion as seen along the line S-S of FIG. 17.
Figure 17:
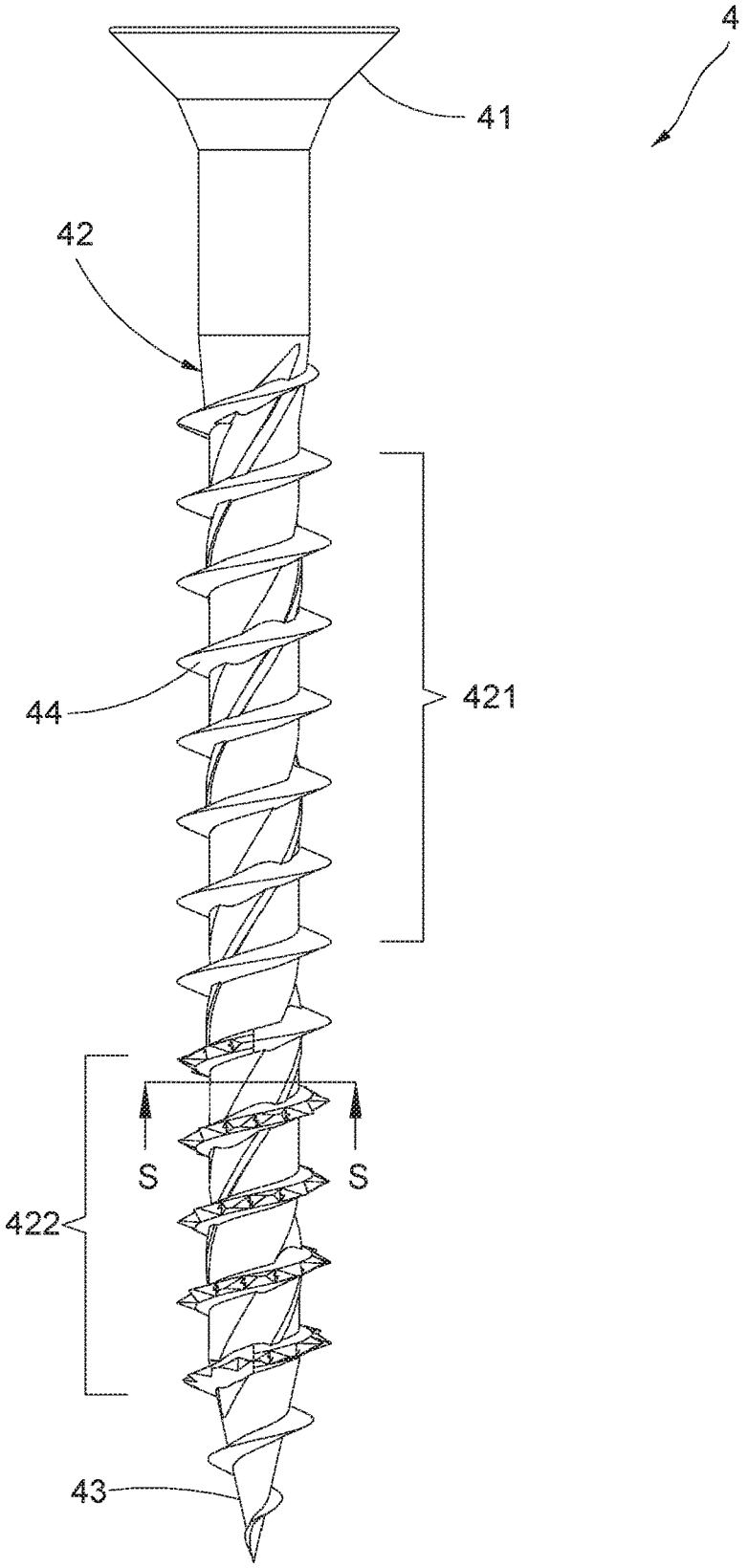
FIG. 17 is a schematic view showing the completed fastener formed in the fifth preferred embodiment.

Referring to FIGS. 15A and 15B show a fifth preferred embodiment of this invention. This embodiment is characterized in that the protrusions 5161 of each convex unit 516 define a main width 5161W1 sequentially arranged from the top end 513 to the bottom end 514. Referring to FIG. 15B, the main width 5161W1 is gradually increased from the top end 513 to the bottom end 514 to thereby divide the shank 42 into a first cutting portion 421 connected to the head 41 and a second cutting portion 422 connected to the drilling portion 43 and allow the slots 45 to be respectively formed on the first cutting portion 421 and the second cutting portion 422 in the threading operation 33. The slots 45 within the first cutting portion 421 define a first slot width smaller than a second slot width of the slots 45 within the second cutting portion 422. Alternatively, referring to FIG. 15A, the rolling surface 510 of each rolling plate 51 includes a first surface section 51A connected to the top end 513 and a second surface section 51B connected to the bottom end 514. The thread operation 33 equips the first surface section 51A and the second surface section 51B with the convex units 516 and the protrusions 5161. The protrusions 5161 of each convex unit 516 defines a first width 5161W2 and a second width 5161W3 for the first surface section 51A and the second surface section 51B respectively. The first width 5161W2 within the first surface section 51A is smaller than the second width 5161W3 within the second surface section 51B to provide an arrangement with two-sectional widths whereby the shank 42 of the metal blank 4 defines a first cutting portion 421 connected to the head 41 and a second cutting portion 422 connected to the drilling portion 43. The slots 45 within the first cutting portion 421 define a first slot width smaller than a second slot width of the slots 45 within the second cutting portion 422 as shown in FIGS. 16 and 17. Thus, the slots 45 within the second cutting portion 422 can accommodate more chips and increase the cutting efficiency to thereby facilitate the cutting operation in the beginning of the screwing operation. Meanwhile, the slots 45 within the first cutting portion 421 can help exclude the chips and increase the whole strength of the fastener. The smaller slot depth of the slots 45 within the first cutting portion 421 allows the chips to accumulate duly and to press a drilling hole (not shown) outwards during the screwing operation to thereby attain the tight engagement of the fastener and the object (not shown) and prevent the drilling portion 43 of the fastener from being swayed.

Figure 18:
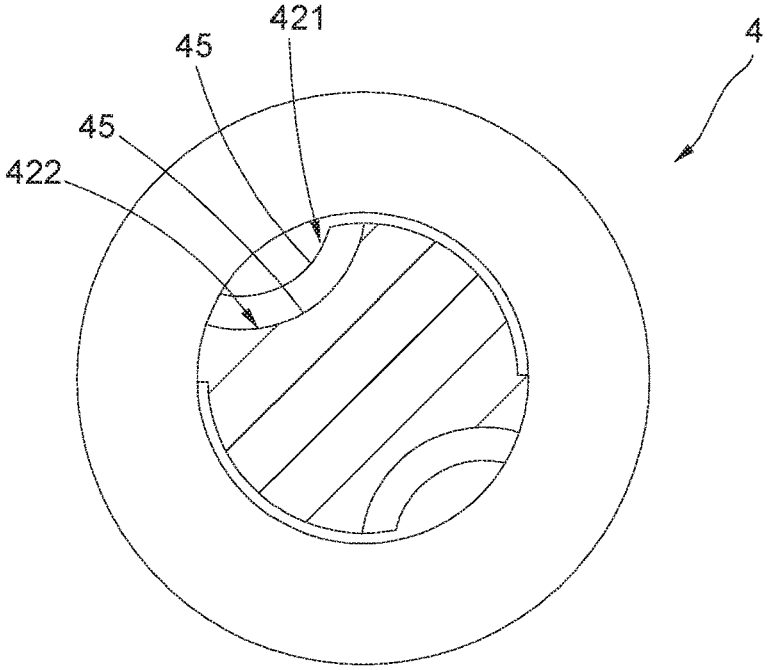
FIG. 18 is a cross-sectional view showing a first slot width and a first slot depth of the slots within the first cutting portion and a second slot width and a second slot depth of the slots within the second cutting portion of a sixth preferred embodiment as seen along the line S-S of FIG. 19.
Figure 19:
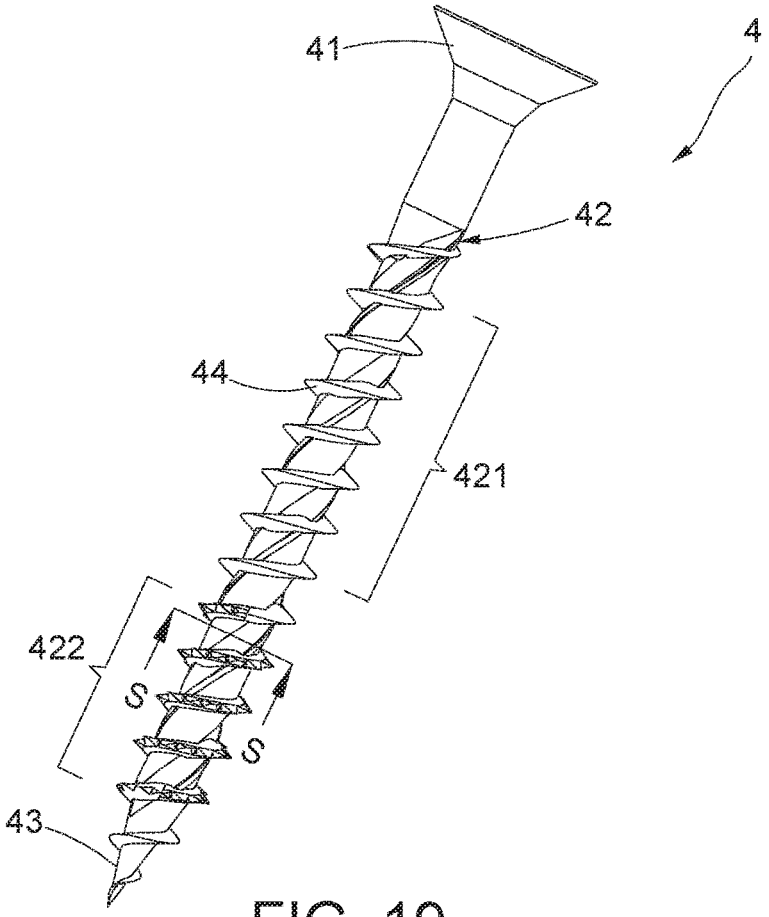
FIG. 19 is a schematic view showing the completed fastener formed in the sixth preferred embodiment.

Referring to FIGS. 18 and 19 show a sixth preferred embodiment of this invention. This embodiment is characterized in that the main protruding height 5161H2 is gradually increased from the top end 513 to the bottom end 514 as shown in FIG. 12B, and the main width 5161W1 is gradually increased from the top end 513 to the bottom end 514 as shown in FIG. 15B. Thus, the slot 45 within the first cutting portion 421 define a first slot width and a first slot depth smaller than a second slot width and a second slot depth of the slots 45 within the second cutting portion 422. Hence, the slots 45 within the second cutting portion 422 can accommodate more chips and enhance the cutting efficiency. Further, the slots 45 within the first cutting portion 421 can not only help exclude the chips outwards, but also increase the whole strength of the fastener. During the screwing operation, the slots 45 can accommodate some chips to thereby prevent the fastener from being loosened or swayed and increase the screwing effect and screwing stability. Meanwhile, the smaller slot depth and slot width of the slots 45 within the first cutting portion 421 allow the chips to accommodate duly. Hence, the chips can press a drilling hole (not shown) outwards during the screwing operation to thereby attain the tight engagement of the fastener and an object to be screwed (not shown) and prevent the drilling portion 43 of the fastener from being swayed. Certainly, the fourth preferred embodiment and the fifth preferred embodiment can be combined together to adjust the slot depth and the slot width of the slots 45 according to needs.

Figure 20:
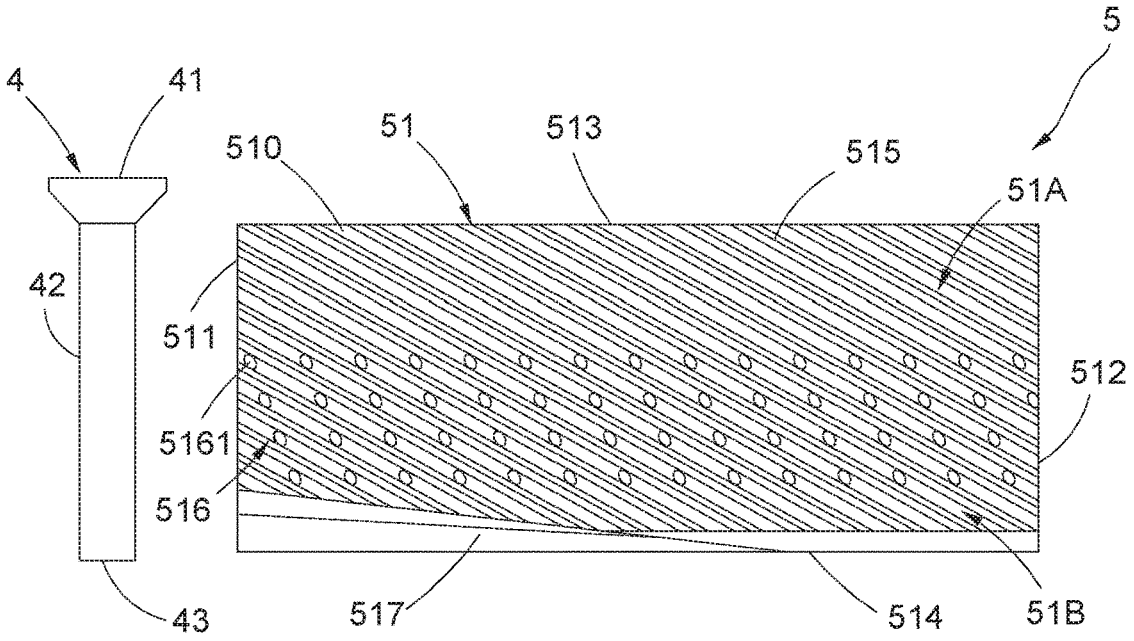
FIG. 20 is a schematic view showing the rolling plate equipped in the threading operation of a seventh preferred embodiment.
Figure 21:
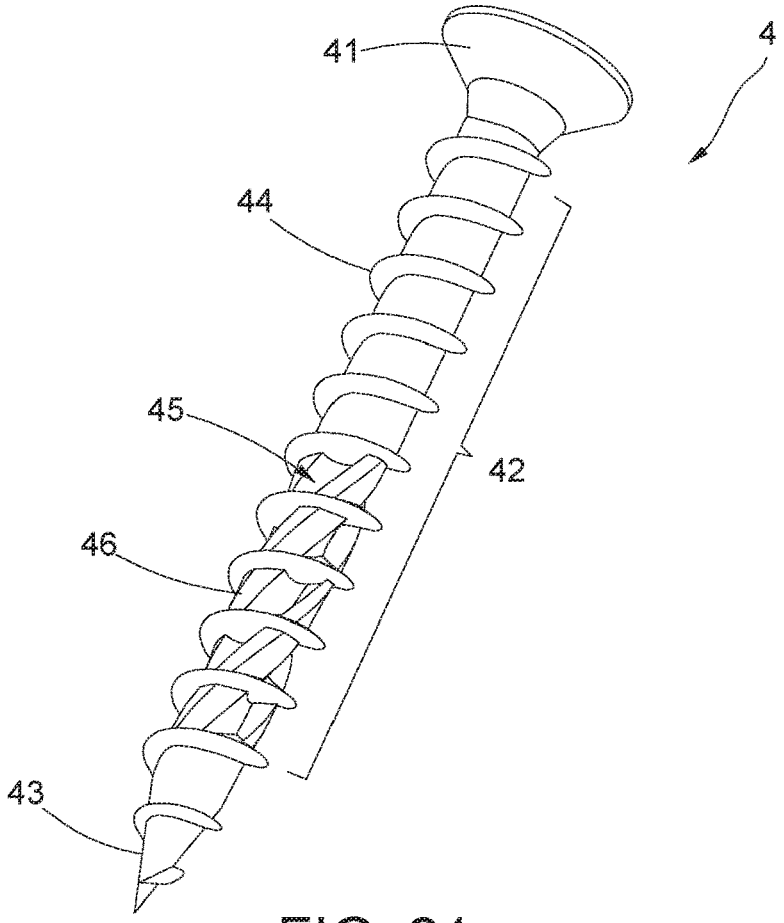
FIG. 21 is a perspective view showing the completed fastener formed in the seventh preferred embodiment.

Referring to FIGS. 20 and 21 show a seventh preferred embodiment of this invention. This embodiment is characterized in that the protrusions 5161 are disposed on part of the rolling surface 510. The protrusions 5161 can extend from the top end 513 or extend from the bottom end 514. Here takes an example that the rolling surface 510 of each rolling plate 51 includes a first surface section 51A connected to the top end 513 and a second surface section 51B connected to the bottom end 514. The protrusions 5161 are disposed in the second surface section 51B. After preparing the metal blank 4 in the preparing operation 31 and shaping the metal blank 4 with the head 41, the shank 42 and the drilling portion 43 in the forming operation 32, the metal blank 4 is then situated between the rolling plates 51 in the threading operation 33 to thereby shape the shank 42 of the metal blank 4 with the thread convolutions 44, the slots 45 and the main ribs 46 formed between five and six thread convolutions 44.

Figure 22:
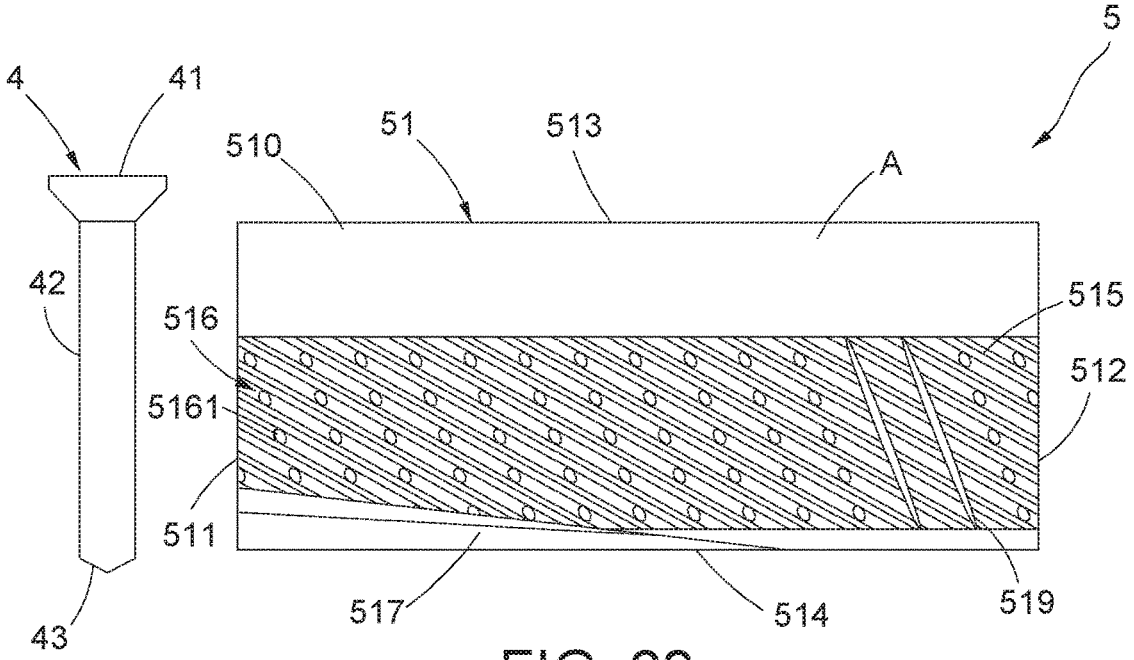
FIG. 22 is a schematic view showing the rolling plate equipped in the threading operation of an eighth preferred embodiment.
Figure 23:
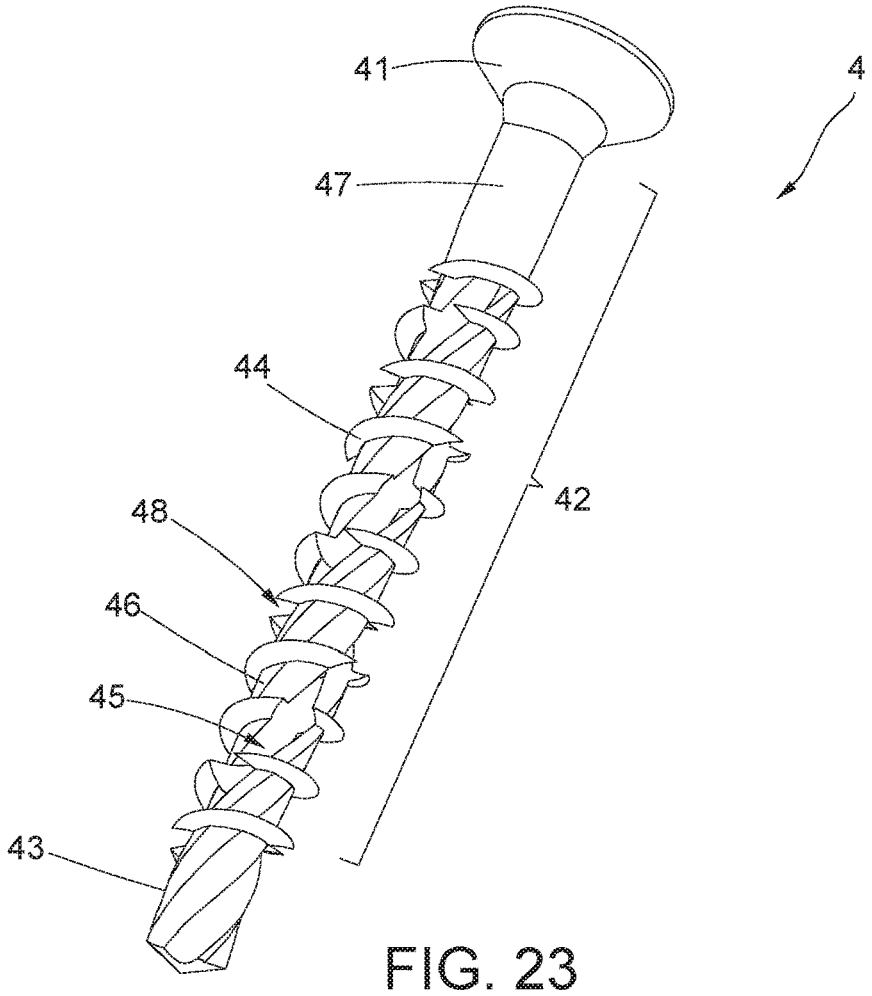
FIG. 23 is a perspective view showing the completed fastener formed in the eighth preferred embodiment.

Referring to FIGS. 22 and 23 show an eight preferred embodiment of this invention. This embodiment is characterized in that the rolling surface 510 includes at least one protuberance 519 and a blank area A. Here takes an example that the blank area A is formed on the rolling surface 510 and connected to the top end 513, and a plurality of protuberances 519 extend from the blank area A to tail forming portion 517 as shown in FIG. 22. Thus, in the threading operation 33, the shank 42 is formed to have a valley 47 situated between the head 41 and the thread convolutions 44 by the blank area A, the thread convolutions 44 by the slit grooves 515, the slots 45 and the main ribs 46 by the protrusions 5161. Meanwhile, a plurality of notches 48 is formed on the thread convolutions 44 of the metal blank 4 by the protuberances 519. Further, the drilling portion 43 is formed to be a self-tapping tail through a processing machine (not shown) in advance. Because the notches 48 communicate with the slots 45, the chips can be excluded outwards from the notches 48 to the slots 45 to thereby accelerate the exclusion of the chips, prevent the exclusion of the chips from being hindered by the thread convolutions 44, and achieve the preferable effect of excluding the chips.

Figure 24:
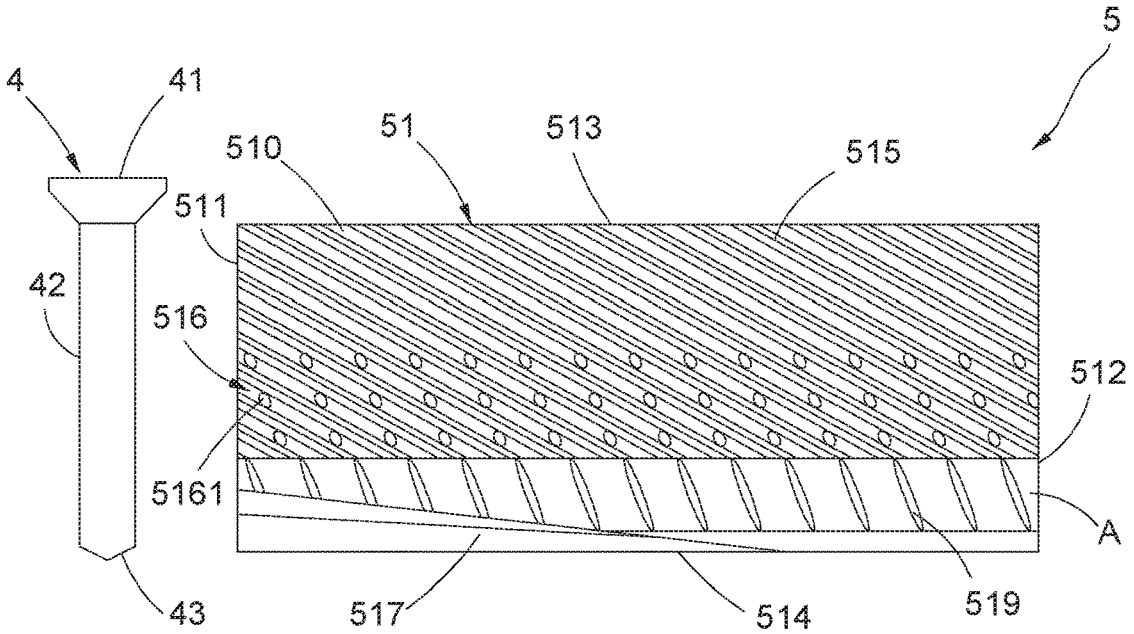
FIG. 24 is a schematic view showing the rolling plate equipped in the threading operation of a ninth preferred embodiment.
Figure 25:
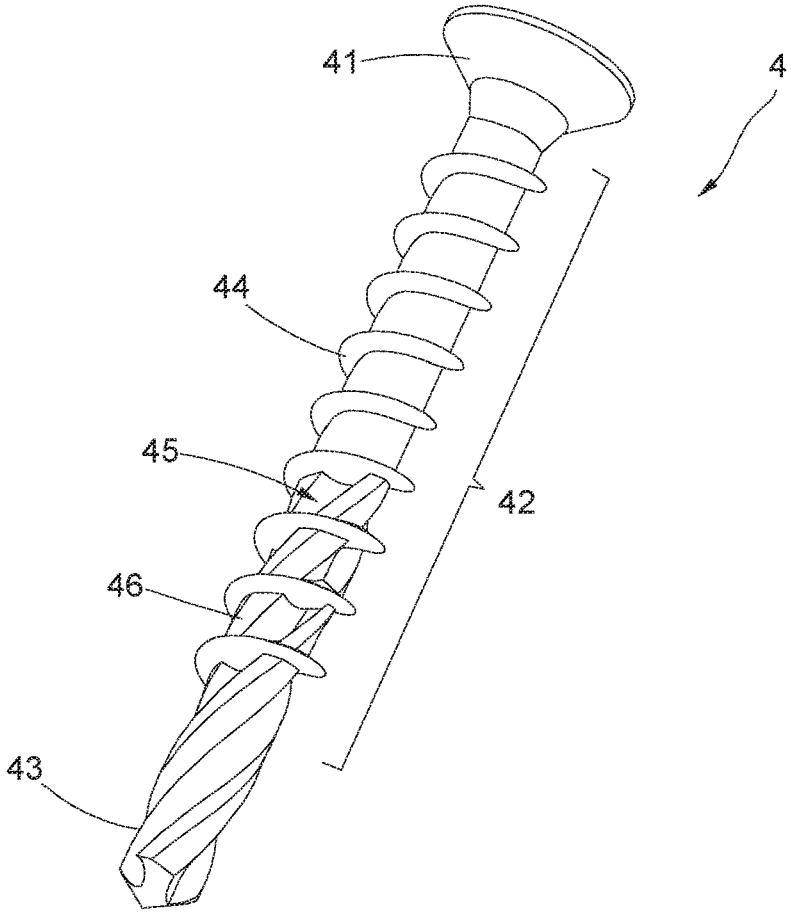
FIG. 25 is a perspective view showing the completed fastener formed in the ninth preferred embodiment.

Referring to FIGS. 24 and 25 show a ninth preferred embodiment of this invention. This embodiment is characterized in that each rolling plate 51 includes a blank area A connected to the tail forming portion 517 and a plurality of protuberances 519 formed on the blank area A. The slit grooves 515 extend from the top end 513 and stop at the blank area A. Each line arranging formed by arranging each convex unit 516 extends from the blank area A and is situated at a place corresponding to the protuberances 519. In this preferred embodiment, the drilling portion 43 is formed to be a self-tapping tail through a processing machine (not shown) in advance. Thus, the method 3 is executed by preparing the metal blank 4 in the preparing operation 31 and forming the metal blank 4 with the head 41, the shank 42 and the drilling portion 43 in the forming operation 32. In the threading operation 33, the metal blank 4 is positioned between the rolling plates 51 and moves from the entrance ends 511 toward the exit end 512. The rolling of the metal blank 4 shapes the shank 42 of the metal blank 4 with the thread convolutions 44 by the slit grooves 515 and the slots 45 and the main ribs 46 by the protrusions 5161. Because the protuberances 519 disposed at a place extending from the line of each convex unit 516 to the tail forming portion 517, and the slit grooves 515 are not disposed on the blank area A, it allows an end of the shank 42 which is connected to the drilling portion 43 to be formed without the thread convolutions 44 and allows the slots 45 and the main ribs 46 to extend to the drilling portion 43. Hence, the preferable screwing effect is attained.

To sum up, the method of this invention includes the preparing operation, the forming operation and the threading operation. The preparing operation prepares a metal blank being a portion cut from a length of a metal material. The forming operation is executed to form a shank, a head and a drilling portion disposed at two ends of the shank on the metal blank. The threading operation is executed to equip a thread rolling set and roll the metal blank between the two rolling plates of the thread rolling set to thereby form the thread convolutions, the slots and the main ribs on the shank of the metal blank, with each slot situated between two adjacent thread convolutions, and each main rib situated between two adjacent slots. Hence, the main ribs can assist the thread convolutions in cutting to thereby increase the cutting efficiency. The slots allow the chips to be excluded outwards quickly and reduce a contact area of the shank and an object to be screwed to thereby accelerate the screwing operation and save labor force. Further, the screwing resistance is reduced. The object to be screwed is prevented from being cracked effectively. The preferable screwing effect is achieved.

While the embodiments of this invention are shown and described, it is understood that further variations and modifications may be made without departing from the scope of this invention.

What is claimed is:

1. A method for manufacturing a multi-functional fastener comprising:

a preparing operation which includes preparing a metal blank, said metal blank being a portion cut from a length of a metal material;

a forming operation which includes shaping said metal blank so that said metal blank is provided with a head, a drilling portion, and a shank extending from said head to said drilling portion; and a threading operation which includes preparing a thread rolling set including two rolling plates opposite each other and rolling said metal blank between said two rolling plates, each of said two rolling plates including a rolling surface, an entrance end formed at one end of said rolling plate, an exit end formed at another end of said rolling plate, a top end defined between said entrance end and said exit end, and a bottom end defined in opposing relationship to said top end, said rolling surface having a plurality of slit grooves recessedly formed thereon and spaced from each other, a plurality of convex units being formed on said rolling surface and alternating with said plurality of slit grooves, each of said plurality of convex units being arranged in a line and including a plurality of protrusions, each of said plurality of protrusions being situated between two adjacent said slit grooves, the rolling of said metal blank between said two rolling plates moving said metal blank from said entrance end to said exit end to thereby forma plurality of thread convolutions, a plurality of slots, and a plurality of main ribs on said shank of said metal blank, with each of said plurality of slots situated between two adjacent said thread convolutions, and each of said plurality of main ribs situated between two adjacent said slots.

2. The method according to claim 1, wherein said drilling portion of said metal blank has a tail member selected from the group consisting of a pointed tail, a self-tapping tail, and a flat tail.

3. The method according to claim 1, wherein an imaginary reference line is defined by passing through a central point of said top end and a central point of said bottom end, each of said plurality of protrusions being inclined to said imaginary reference line.

4. The method according to claim 1, wherein an imaginary reference line is defined by passing through a central point of said top end and a central point of said bottom end, each of said plurality of protrusions being parallel to said imaginary reference line.

5. The method according to claim 1, wherein a hole is formed at one end of each of said plurality of protrusions of said rolling surface and is configured to form an auxiliary rib on each of said plurality of main ribs of said metal blank in said threading operation.

6. The method according to claim 1, wherein each of said plurality of protrusions includes a straight surface and a curved surface connected to said straight surface.

7. The method according to claim 1, wherein each of said plurality of protrusions is formed into either a curved shape or a conical shape.

8. The method according to claim 1, wherein an imaginary reference line is defined by passing through a central point of said top end and a central point of said bottom end, each line formed by arranging each of said plurality of convex units being inclined to said imaginary reference line.

9. The method according to claim 1, wherein an imaginary reference line is defined by passing through a central point of said top end and a central point of said bottom end, each line formed by arranging each of said plurality of convex units being parallel to said imaginary reference line.

10. The method according to claim 1, wherein said rolling surface includes at least one protuberance configured to form a plurality of notches on said plurality of thread convolutions of said metal blank in said threading operation.

11. The method according to claim 5, wherein said auxiliary rib protrudes from a surface of each of said plurality of main ribs at a rib protruding height, said rib protruding height being at least 0.05 mm.

12. The method according to claim 1, wherein two slot reference lines passing through two ends of each of said plurality of slots extend and converge at a center of said shank of said metal blank to define a slot included angle, said plurality of slots defining a plurality of slot included angles, the sum of said plurality of slot included angles being defined as a first angle, a second angle being defined by subtracting said first angle from 360 degrees, a ratio of said first angle to said second angle being between 1:7 and 3:5.

13. The method according to claim 5, wherein an outer periphery of said shank of said metal blank defines a peripheral envelope length, and said auxiliary rib defines a peripheral width, a ratio of said peripheral envelope length of said shank to said peripheral width of said auxiliary rib being 1 to at least 0.020.

14. The method according to claim 1, wherein said plurality of slots and said plurality of main ribs of said metal blank are formed between five and six thread convolutions.

15. The method according to claim 1, wherein said plurality of protrusions of each of said plurality of convex units protrude from said rolling surface at an identical protruding height sequentially arranged from said top end to said bottom end to thereby allow said threading operation to form said plurality of slots of said metal blank with an equal slot width and an equal slot depth.

16. The method according to claim 1, wherein said plurality of protrusions of each of said plurality of convex units protrude from said rolling surface at a main protruding height sequentially arranged from said top end to said bottom end, said main protruding height being gradually increased from said top end to said bottom end to thereby divide said shank of said metal blank into a first cutting portion connected to said head and a second cutting portion connected to said drilling portion in said threading operation and allow said plurality of slots to be respectively formed on said first cutting portion and said second cutting portion, said plurality of slots within said first cutting portion defining a first slot depth smaller than a second slot depth of said plurality of slots within said second cutting portion.

17. The method according to claim 1, wherein said rolling surface of each of said two rolling plates includes a first surface section connected to said top end and a second surface section connected to said bottom end, said thread operation equipping said first surface section and said second surface section with said plurality of convex units and protrusions, said protrusions of each of said plurality of convex units protrude from said first surface section and from said second surface section at a first protruding height and a second protruding height respectively, said first protruding height within said first surface section being smaller than said second protruding height within said second surface section to provide an arrangement with two-sectional heights whereby said shank of said metal blank defines a first cutting portion connected to said head and a second cutting portion connected to said drilling portion, and said plurality of slots are respectively formed on said first cutting portion and said second cutting portion in said threading operation, said plurality of slots within said first cutting portion defining a first slot depth smaller than a second slot depth of said plurality of slots within said second cutting portion.

18. The method according to claim 1, wherein said plurality of protrusions of each of said plurality of convex units define a main width sequentially arranged from said top end to said bottom end, said main width being gradually increased from said top end to said bottom end to thereby divide said shank into a first cutting portion connected to said head and a second cutting portion connected to said drilling portion and allow said plurality of slots to be respectively formed on said first cutting portion and said second cutting portion in said threading operation, said plurality of slots within said first cutting portion defining a first slot width smaller than a second slot width of said plurality of slots within said second cutting portion.

19. The method according to claim 1, wherein said rolling surface of each of said two rolling plates includes a first surface section connected to said top end and a second surface section connected to said bottom end, said thread operation equipping said first surface section and said second surface section with said plurality of convex units and protrusions, said protrusions of each of said plurality of convex units defines a first width and a second width for said first surface section and said second surface section respectively, said first width within said first surface section being smaller than said second width within said second surface section to provide an arrangement with two-sectional widths whereby said shank of said metal blank defines a first cutting portion connected to said head and a second cutting portion connected to said drilling portion and said plurality of slots are respectively formed on said first cutting portion and said second cutting portion in said threading operation, said plurality of slots within said first cutting portion defining a first slot width smaller than a second slot width of said plurality of slots within said second cutting portion.

20. The method according to claim 1, wherein each of said two rolling plates includes a blank area and a plurality of protuberances formed on said rolling surface.

* * * * *